US007390206B2

(12) United States Patent
Sheremeta et al.

(10) Patent No.: US 7,390,206 B2
(45) Date of Patent: Jun. 24, 2008

(54) CENTRAL VACUUM SYSTEM MOUNTING FLANGE AND HOSE CUFF FOR USE WITH STANDARD ELECTRICAL OUTLETS

(75) Inventors: James George Sheremeta, Orangeville (CA); Daniel David Richard Mika, Sarnia (CA)

(73) Assignee: Plastiflex Canada Inc, Orangeville, Ontario (CA)

( * ) Notice: Subject to any disclaimer, the term of this patent is extended or adjusted under 35 U.S.C. 154(b) by 394 days.

(21) Appl. No.: 11/168,844

(22) Filed: Jun. 28, 2005

(65) Prior Publication Data

US 2006/0292908 A1 Dec. 28, 2006

(51) Int. Cl.
*H01R 4/60* (2006.01)

(52) U.S. Cl. ..... 439/191; 439/192; 174/47

(58) Field of Classification Search ..... 439/191–194, 439/536; 174/66, 55, 56, 60, 47
See application file for complete search history.

(56) References Cited

U.S. PATENT DOCUMENTS

| | | | | | |
|---|---|---|---|---|---|
| 4,188,081 | A | * | 2/1980 | Holden et al. | 439/192 |
| 4,211,457 | A | * | 7/1980 | Meadows | 439/192 |
| 4,618,195 | A | * | 10/1986 | Keane | 439/191 |
| 4,758,170 | A | | 7/1988 | Hayden | |
| 4,895,528 | A | | 1/1990 | Choiniere et al. | |
| 5,349,146 | A | * | 9/1994 | Radabaugh | 200/61.6 |
| 5,578,795 | A | | 11/1996 | Ward | |
| 5,886,299 | A | | 3/1999 | Ward | |

* cited by examiner

*Primary Examiner*—Tho D. Ta
(74) *Attorney, Agent, or Firm*—Lewis B. Sternfels; Jeffrey Pervanas

(57) ABSTRACT

A mounting plate having an orienting portion facilitates orienting the vacuum connection opening of the mounting plate with respect to an anticipated orientation of a receptacle and electrical box. The orienting portion is optionally releasably attachable to the main body of the mounting plate which main body comprises the vacuum connection opening. The mounting plate is mounted prior to installation of the electrical receptacle in the electrical box. The orienting portion of the mounting plate facilitates orienting the vacuum connection opening in a known orientation with respect to an anticipated orientation of the electrical receptacle when inserted in the electrical box. After installation of the inlet valve and the electrical receptacle, a hose cuff having standard electrical terminals oriented with respect to the vacuum connection of the hose cuff may be simultaneously inserted into the electrical receptacle and the vacuum connection opening. The electrical terminals in the hose cuff are oriented with respect to the vacuum connection in a second known orientation corresponding to the first known orientation such that the electrical terminals mate with the electrical receptacle which has been installed in the electrical box when the vacuum connection opening receives the vacuum connection. In this manner, a hose cuff utilizing standard electrical terminals may be mated with an electrical terminal without interfering with the electrical box. Furthermore, because the orienting portion is releasably attached to the main body, the orienting portion can be removed to avoid interference with other trades.

19 Claims, 17 Drawing Sheets

CENTRAL VACUUM SYSTEM MOUNTING FLANGE AND HOSE CUFF FOR USE WITH STANDARD ELECTRICAL OUTLETS

FIELD OF THE INVENTION

This invention relates to inlet valves and inlet valve assemblies used in association with central vacuum cleaning systems. In particular, this invention relates to inlet valves and inlet valve assemblies, and a method for installing the inlet valves and inlet valve assemblies of the type that utilize both high voltage and low voltage wiring connections.

BACKGROUND OF THE INVENTION

In the past, there have been many different types of inlet valves and inlet valve assemblies. In general, all inlet valves have at least a low voltage connection. The low voltage connection provides for remote switching to activate the central vacuum source of the central vacuum system.

Other types of central vacuum system also provide for a high voltage connection, such as 110 volts, in addition to the low voltage connection. The high voltage connection is generally used in current carrying flexible hoses to provide power to an attachment for the current carrying flexible hose. Such attachments may include beater bars which generally rotate and beat a floor surface, such as a carpet, to loosen dirt so that a vacuum can lift up the dirt.

In general, different types of high voltage electrical connections have been provided to provide power in current carrying flexible hoses. For instance, the hose cuff may be connected to an inlet valve, and, a separate connection may be made to a power source.

However, it is generally less convenient if two separate connections are required, one for the high voltage source and another for the vacuum and low voltage connection. Therefore, there has been a movement in the prior art towards a direct connect hose which provides a connection both to the electrical power source and also the vacuum connection to the inlet valve at the same time. Such systems are shown, for instance, in U.S. Pat. No. 5,578,795 to Ward. However, prior art devices such as those shown in Ward involve a unique connection for both the inlet valve and the high voltage power source. This unique connection is generally smaller and involves the use of electrical terminals or pins which are inserted into smaller electrical sockets. The difficulty with these types of terminals or pins is that they are not robust and may be broken. This occurs, for instance, due to an involuntary rotational movement by the user when inserting or removing the hose cuff. Any rotational movement can damage the pins thereby rendering the high voltage portion of the hose useless requiring replacement of the hose or use of the hose only without power being sent to any attachments.

Some prior art devices, such as those disclosed in U.S. Pat. No. 4,758,170 to Hayden have a high voltage AC electrical power receptacle forming part of the inlet valve body. However, these prior art devices generally require a licensed electrician to install the electrical power receptacle portion of the inlet valve which generally increases the cost of installation. This is the case at least because during installation the high voltage connection can only be made by a licensed electrician. This means that, during installation of the vacuum system, the vacuum system installer must initially come in to set the locations for all of the inlet valves as well as rough in the low voltage electrical connection, and, the electrician must then complete the high voltage electrical connection, and the vacuum installer must then return after the electrician has made the high voltage electrical connection to complete the vacuum system installation. Clearly, the separate visit by the electrician results in additional costs. Furthermore, there are additional costs in coordinating the attendance of the various trades at the correct time. Further compounding this issue is the fact that in many jurisdictions electrical connections such as these types of high voltage connections must be inspected thereby requiring a further visit or at least coordination with the appropriate building and/or fire inspector.

Accordingly, there is a need in the art for a more robust direct connect hose cuff having more robust electrical connections that avoid damage during insertion and removal. There is also a need in the art for a less costly installation procedure requiring fewer parts, less coordination amongst the trades for installation as well as fewer inspections by the appropriate building inspectors.

SUMMARY OF THE INVENTION

Accordingly, it is an object of this invention to at least partially overcome the disadvantages of the prior art. Also, it is an object of this invention to provide an improved type of inlet valve connection facilitating a direct connect hose cuff having more robust pins. Furthermore, there is a need in the art for an improved type of installation procedure which avoids overlap of trades and coordination of the number of trades.

Accordingly, in one of its aspects, this invention provides a mounting plate for use in mounting an inlet valve for use in association with a central vacuum cleaning system, said mounting plate comprising: a main body having a vacuum connection opening; an orienting portion for orienting the vacuum connection opening in a known orientation with respect to an anticipated orientation of an electrical receptacle when inserted in an electrical box; wherein the vacuum connection opening receives a vacuum connection of a hose cuff, said hose cuff having electrical terminals oriented with respect to the vacuum connection of the hose cuff corresponding to the first known orientation, such that the electrical terminals mate with the electrical receptacle inserted in the electrical box when the vacuum connection opening receives the vacuum connection.

Accordingly, in a further aspect, the present invention provides a method for connecting a current carrying flexible hose to an inlet valve, said method comprising: (a) mounting a main body having a vacuum connection opening for the inlet valve at a first known orientation with respect to an electrical receptacle inserted in an electrical box; (b) providing a hose cuff at one end of the current-carrying flexible hose having electrical terminals oriented with respect to the vacuum connection in a second known orientation corresponding to the first known orientation such that the electrical terminals mate with the electrical receptacle inserted in the electrical box when the vacuum connection opening receives the vacuum connection.

Accordingly in a still further aspect, the present invention provides a hose cuff for mating with a vacuum connection opening and a standard electrical receptacle inserted in a standard electrical box, said hose cuff comprising: a vacuum connection, having a center line, for mating with the vacuum connection opening of the inlet valve; a pair of standard electrical terminals fixed with respect to the vacuum connection and aligned along a first axis; and wherein said center line of the vacuum connection opening is substantially perpendicular to a plane containing the first axis and offset from the first axis by a first distance.

Accordingly, in one preferred embodiment, an advantage of the present invention is that a direct connect hose cuff having standard electrical terminals can be used to provide a high voltage connection to an attachment for a current carrying flexible hose. This occurs, at least in part, because the hose cuff has standard electrical terminals which can engage into an electrical plug of an electrical receptacle, providing a more robust electrical connection.

In a further embodiment, additional advantages involve more direct installation. This arises, at least in part, by avoiding the need for a separate visit by an electrician. In one preferred embodiment, the vacuum hose connection in the inlet valve is installed at a known orientation with respect to the electrical receptacle. This is done even though the electrical receptacle is not installed generally at the time the vacuum system is installed by using the fact that all electrical receptacles have a standard distance with respect to the other components of the electrical box. In a preferred embodiment, a mounting flange is used to orient the vacuum connection opening with respect to the securing holes which are used during installation of the actual electrical receptacle. In this way, the vacuum hose connection may be oriented in a first known orientation with respect to the anticipated orientation of the electrical connection when it is eventually inserted into the electrical box. In one preferred embodiment, this provides for the vacuum system to be roughed in without the need for an electrician to make a separate electrical connection for a high voltage connection associated with the vacuum system at least in part because the inlet valve would be set in a known orientation with respect to the electrical receptacle, which known orientation corresponds to the orientation of the electrical terminals and vacuum connection of the hose cuff.

Furthermore, in a preferred embodiment, the orienting portion used on the mounting flange for orienting the vacuum connection opening with respect to the anticipated orientation of the electrical receptacle is removable. This can be done in one preferred embodiment, for instance, by having a frangible portion which permits the orienting portion to be removed from the main body. In this way, once the main body of the mounting plate having the vacuum connection opening is secured in the appropriate orientation with respect to the anticipated position of the electrical receptacle, the orienting portion can be removed thereby avoiding any interference with the other trades, such as the electrician.

A further advantage of at least one embodiment of the present invention is that no additional wall valve electrical wiring is required. In other words, the inlet valve as installed does not contain any high voltage electrical wiring. This decreases the costs associated with the inlet valve. This further decreases the cost of installing and maintaining the electrical inlet valve. For instance, long term difficulties regarding wiring can be decreased as all high voltage power emanates from a standard electrical box. Furthermore, because a standard electrical box is used without any interference between the inlet valve and the electrical box, this invention can be easily adapted for use in non-custom built homes.

In a further preferred embodiment, the hose cuff used to mate with the electrical receptacle and the inlet valve is arranged such that the vacuum connection is located below the electrical receptacle. This is done for a number of reasons. First, the location of the electrical receptacle to the structural element is variable, either on the left or right side of the stud. Thus, if the electrical receptacle was located on the same plane as the vacuum inlet valve, it would be necessary to have a left hose cuff connection and a right hose cuff connection because of the fact that the structural element would increase and vary the distance between the electrical receptacle and vacuum inlet valve and would prevent the hose cuff from being interchangeable between the vacuum inlet valve on the left side and a vacuum inlet valve on the right side of the electrical receptacle. Furthermore, by having the electrical terminals above the vacuum inlet valve, it is easier for the consumer to insert the electrical terminals, which are generally smaller and more difficult to insert, into the electrical receptacle while simultaneously inserting the vacuum connection of the hose cuff into the vacuum connection opening of the inlet valve. This is the case at least because the user will be able to see the electrical terminals, which are on top, contrary to the case if the electrical terminals were below the vacuum connection. Furthermore, the electrical terminals have a space between them and are shorter than the vacuum connection of the hose cuff which permits the user to view the vacuum connection of the hose cuff while at the same time viewing the electrical terminals. Clearly, this would not be the case if the vacuum connection was located above the electrical terminals.

In a further preferred embodiment, the electrical terminals may be rotatable from a first position where their lengthwise axis is substantially parallel to the center line of the vacuum connection, to a second position where the lengthwise axis is substantially perpendicular to the center axis of the vacuum connection. This could be done, for instance, to provide the same hose cuff to be used with vacuum inlet valves that have not been installed with an electrical receptacle oriented with respect to the vacuum connection opening of the inlet valve.

In a further preferred embodiment, a key way may be present on the vacuum connection of the hose cuff. Preferably, a female key way is present on the vacuum connection of the hose cuff which mates with a corresponding male key way on the vacuum connection opening of the inlet valve. In this way, the fact that the female key way is located on the vacuum connection of the hose cuff would permit the same hose cuff to be used in vacuum inlets which do not have a male key way. Furthermore, the presence of the key way system would assist in aligning the electrical terminals for insertion into the electrical receptacle while the vacuum connection of the hose cuff is inserted into the vacuum connection opening of the inlet valve.

Further aspects of the invention will become apparent upon reading the following detailed description and drawings, which illustrate the invention and preferred embodiments of the invention.

BRIEF DESCRIPTION OF THE DRAWINGS

In the drawings, which illustrate embodiments of the invention.

DETAILED DESCRIPTION OF THE PREFERRED EMBODIMENTS

Preferred embodiments of the invention and its advantages can be understood by referring to the present drawings. In the present drawings, like numerals are used for like and corresponding parts of the accompanying drawings.

Figure 1:
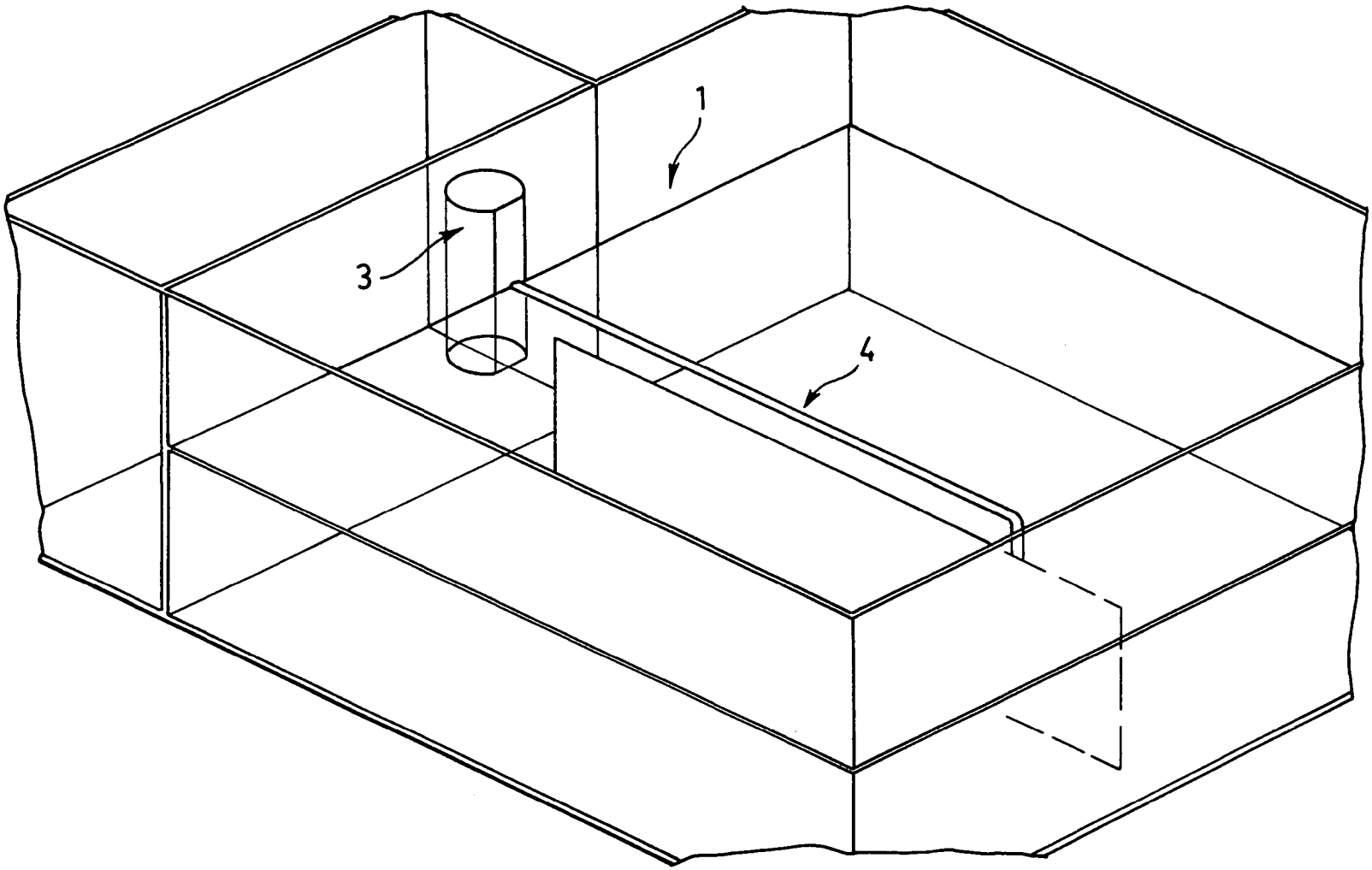
FIG. 1 is general representation of a central vacuum system.

FIG. 1 symbolically illustrates one possible central vacuum system, shown generally by reference numeral 1, with which the present invention may be used. As shown in FIG. 1, the vacuum system 1 comprises a central vacuum source, shown generally by reference numeral 3, connected by way of pipes, shown generally by reference numeral 4, to at least one vacuum inlet valve. It is understood that the central vacuum system 1 may have several links of pipe 4 all leading to the same vacuum source 3. It is further understood that the vacuum system 1 may be installed in any type of structure, such as a house, apartment, residential condominium, commercial condominium unit or industrial unit. There is no substantial restriction on the location or structure where the central vacuum system 1 may be installed.

Figure 2:
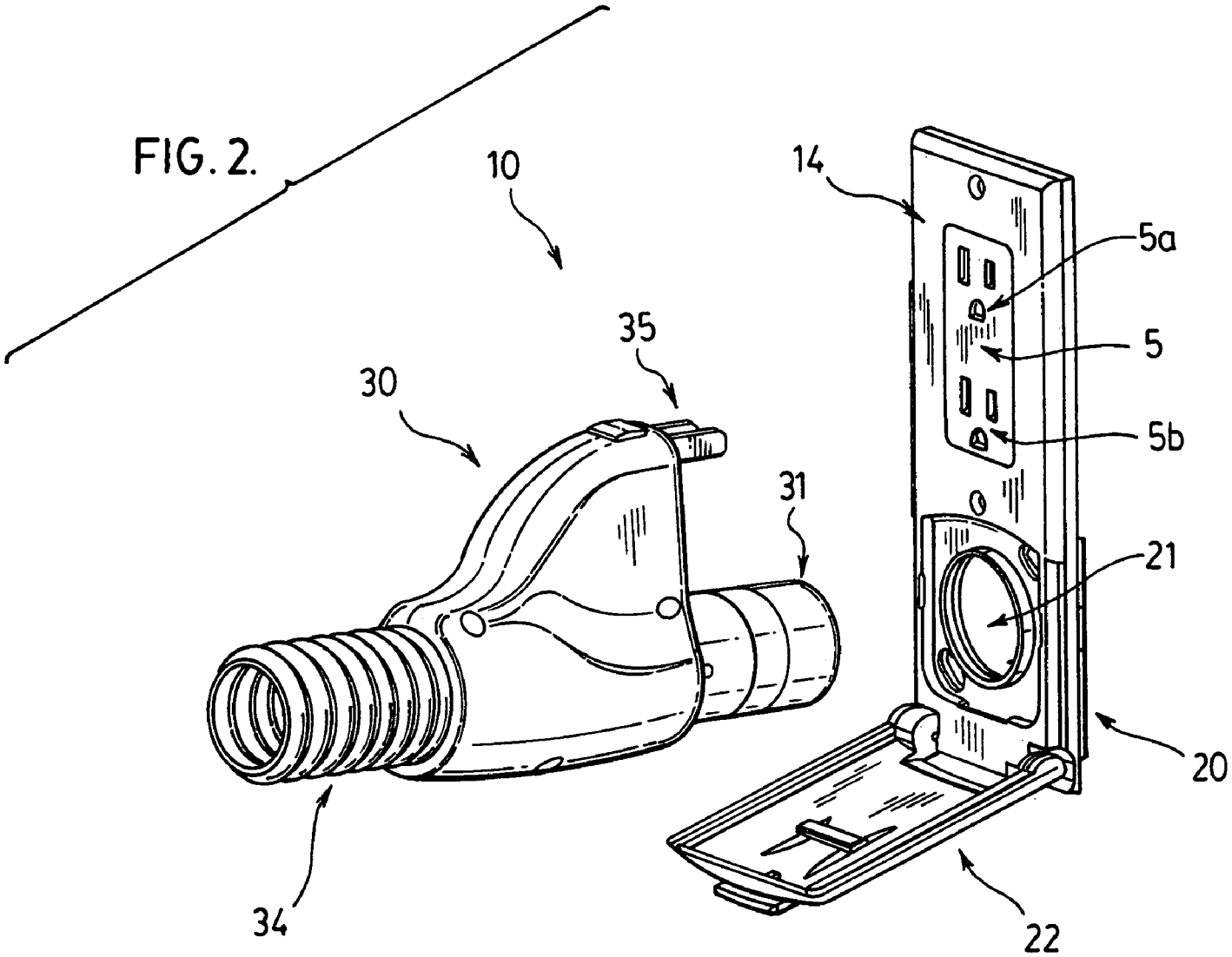
FIG. 2 is a perspective view of a hose cuff and vacuum inlet according to one embodiment of the present invention.

FIG. 2 shows a combination, illustrated generally by reference numeral 10, of a hose cuff 30 and a vacuum inlet valve 20 according to one preferred embodiment of the present invention. As illustrated in FIG. 2, a vacuum inlet valve 20 is oriented in a predetermined orientation with respect to the electrical receptacle 5 when the electrical receptacle 5 has been inserted in an electrical box 8 (shown in FIG. 3). The hose cuff 30 has electrical terminals 35 which are oriented with respect to the vacuum connection 31 of the hose cuff 30 in an orientation which corresponds to the orientation of the inlet valve 20 with respect to the electrical receptacle 5 such that the electrical terminals 35 on the hose cuff 30 mate with at least one of the plugs 5*a* or 5*b* of the electrical receptacle 5 when the vacuum inlet connection opening 21 receives the vacuum connection 31. It is understood that the known orientation of the electrical receptacle 5 with respect to the inlet valve 20 may be any known orientation and that the orientation of the terminals 35 to the vacuum connection 31 will correspond to this known orientation.

As also illustrated in FIG. 2, the inlet valve 20 and electrical receptacle 5 may have a wall inlet face plate 14 which preferably covers both the electrical receptacle 5 and the vacuum inlet valve 20. The wall inlet face plate 14 is also sometimes referred to as the cover plate. In one embodiment, the wall inlet face plate 14 may be integrally formed with the vacuum inlet valve 20 but other configurations are also possible. Furthermore, in one preferred embodiment, as shown in FIG. 2, the vacuum inlet valve 14 may be integrally formed with a cover for the electrical box 8. Alternatively, a separate electrical cover (not shown) may be used to cover the electrical box 8.

As also illustrated in FIG. 2, the vacuum inlet valve 20 may have a vacuum cover 22. The vacuum cover 22 may have aesthetic purposes such as to provide a pleasing appearance when the inlet valve 20 is not in use. The vacuum cover 22 may also provide a sealing means (not shown) for substantially sealing the vacuum inlet opening connection 21 when not in use such that the vacuum generated by the vacuum source 3 of the vacuum system 1 can be used at other inlet valves (not shown). As illustrated in FIG. 2, the cover 22 may be attached to the wall inlet face plate 14, or other arrangements for temporarily covering and/or sealing the vacuum inlet connection opening may be used.

As also illustrated in FIG. 2, the hose cuff 30 may have a current carrying flexible hose 34. The current carrying flexible hose 34 may communicate with the vacuum connection 31 so that suction created by the vacuum source 3 and received through the vacuum connection 31 can be transferred to the end of the hose 34 for vacuuming. The current carrying flexible hose 34 may also have an electrical connection to the terminals 35 providing a high voltage electrical connection to provide power to an attachment (not shown), which attachments may include, without limitation, a beater bar which generally rotates and beats a floor surface, such as a carpet, to loosen the dirt while a vacuum generated by the vacuum source 3, through the pipes 4, inlet valve 21, vacuum connection 31 and hose 34 can lift the dirt up and transport it through the vacuum system 1 to a dirt collector located usually near the vacuum source 3.

Figure 3:
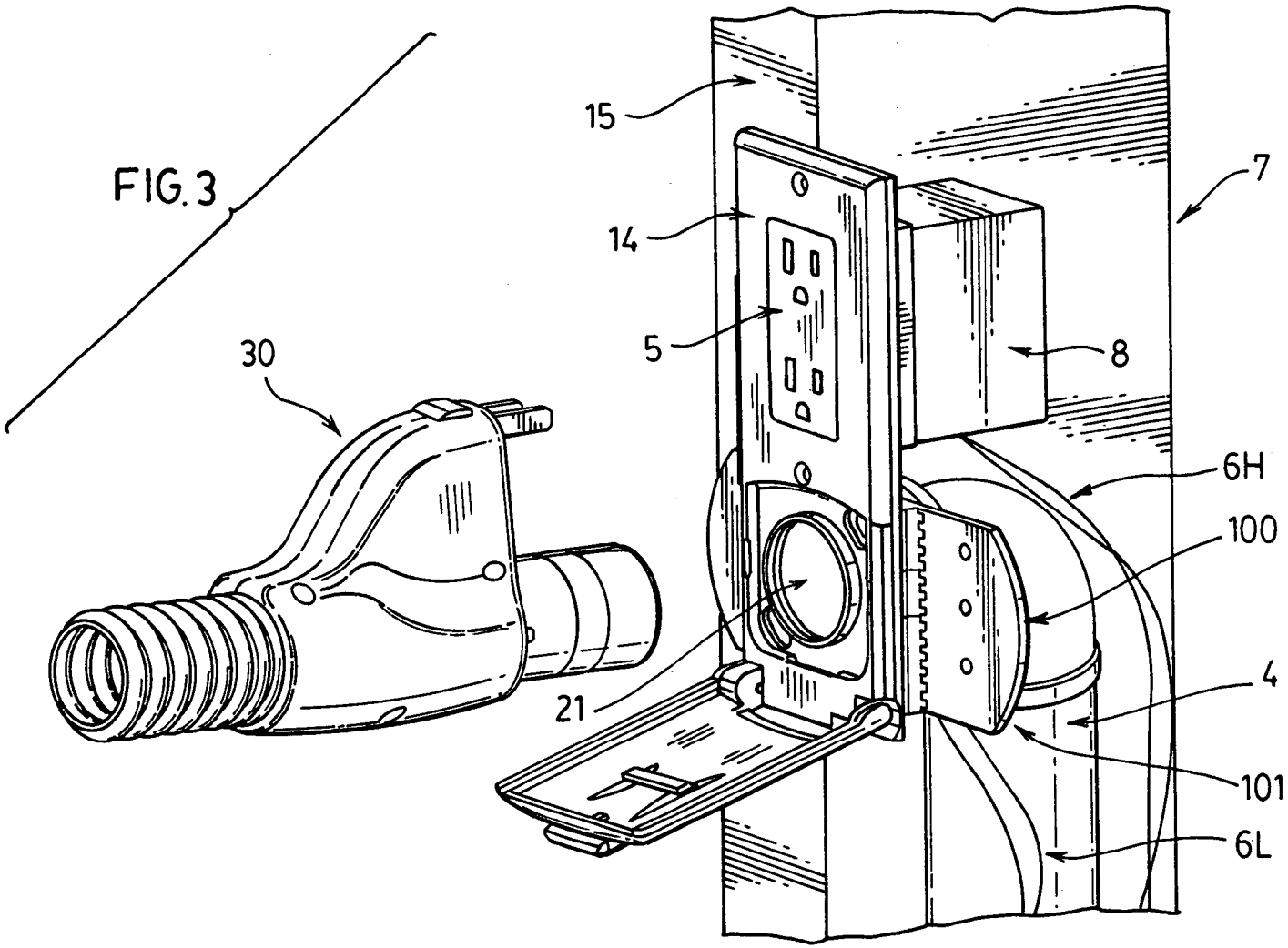
FIG. 3 is a perspective representation of the hose cuff and vacuum inlet illustrated in FIG. 2 showing electrical and vacuum connections behind the wall.

It is understood that the inlet valve 20 and electrical receptacle 5 illustrated in FIG. 2 will generally be installed in a wall which is shown generally by reference numeral 15 or other surface of a structure in which the central vacuum system 1 has been installed. FIG. 3 illustrates the connections behind the wall 15 in a translucent appearance to illustrate the connection behind the wall.

As illustrated in FIG. 3, the electrical receptacle 5 is installed in an electrical box 8. Generally, the electrical box 8 will be a standard electrical box 8 having standard dimensions as is known in the art. It is understood that the electrical box 8 and electrical receptacle 5 may be different for different jurisdictions. The electrical box 8 and electrical receptacle 5 illustrated in FIG. 3 correspond to the North American dimensions and standards, but it is understood that the present invention is not restricted to the North American standards. FIG. 3 illustrates the high voltage electrical connection 6 from the electrical box 8 to the main power source (not shown). FIG. 3 also illustrates the pipe 4 connecting the central vacuum source 3 to the vacuum inlet connection opening 21.

FIG. 3 also illustrates the main body 101 of the mounting plate 100 according to one preferred embodiment of the main body 101 of the present invention. The operation of the mounting plate 100 will be described more fully below. FIG. 3 also illustrates a structural element shown generally by reference numeral 7, to which the electrical box 8 and the mounting plate 100, in this embodiment, are attached. In the embodiment shown in FIG. 3, the structural element 7 is a wooden stud, but it is understood that any type of structural element may be used. It is also understood that while both the main body 101 of the mounting plate 100 and the electrical box 8 are secured to the same structural element 7, this need not necessarily be the case, but rather the electrical box 8 may be connected to a different structural element 7 than the mounting plate 100, provided that the first known orientation of the electrical receptacle 5 with respect to the inlet valve 21 remains substantially constant during use with the hose cuff 30.

Figure 4:
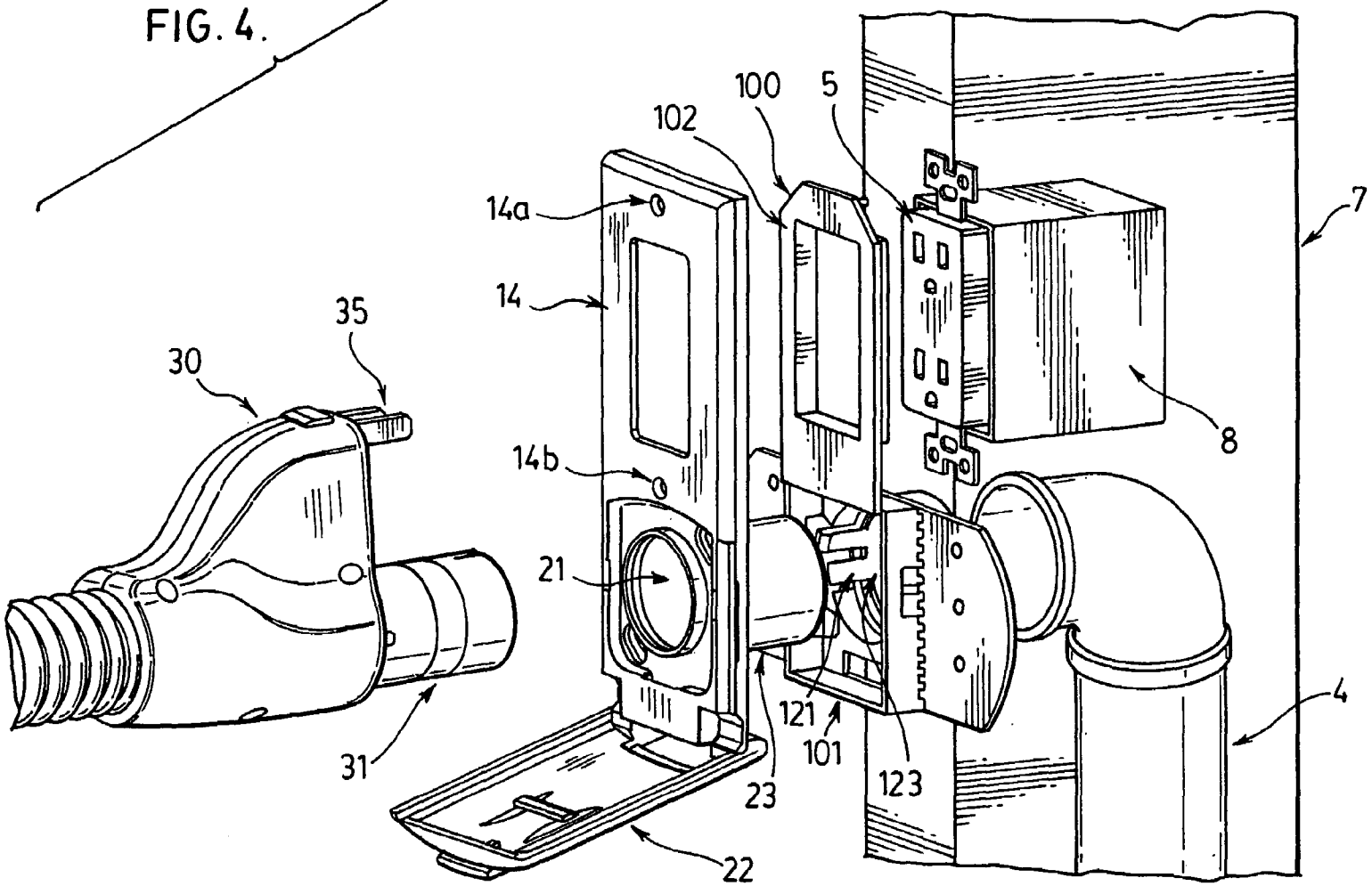
FIG. 4 illustrates an exploded perspective view of the hose cuff and vacuum inlet illustrated in FIGS. 2 and 3.

FIG. 4 illustrates an exploded view of the embodiment shown in FIG. 3 showing generally the connection and attachment of the various components according to one embodiment. As illustrated in FIG. 4, according to a preferred embodiment, the mounting plate 100 generally comprises a first main body 101 and a second orienting portion 102. The main body 101 will generally comprise the vacuum connection opening 121 which mates with the pipe 4 and receives the vacuum connection 31 of the hose cuff 30. The orienting portion 102 assists in orienting the vacuum connection opening 121 with respect to the electrical receptacle 5 such that the electrical terminals 35 on the hose cuff will mate with at least one plug 5*a*, 5*b* in the electrical receptacle 5 inserted in the electrical box 8 when the vacuum connection opening 121 receives the vacuum connection 31 of the hose cuff 30.

It is understood that FIG. 4 shows the electrical receptacle 5 inserted in the electrical box 8 and also the orienting portion 101 of the mounting plates. It is understood, though, that the mounting plate 100 will generally be installed before the electrical receptacle 5 has been inserted into the electrical box 8 as discussed more fully below. Because of this, the orienting portion 102 will orient the vacuum connection opening 121 with respect to the anticipated orientation of the electrical receptacle 5 when inserted in the electrical box 8, rather than the actual position of receptacle 5 because the mounting plate 100 will generally be installed and the piping 4 roughed in before the electrical receptacle 5 has been inserted into the electrical box 8. Furthermore, the orienting portion 102, in at least one preferred embodiment can be removed after the vacuum connection opening 121 has been mounted in the first orientation with respect to the anticipated position of the electrical receptacle 5, as discussed more fully below.

To facilitate the orientation of the vacuum connection opening 121 with respect to the anticipated position of the receptacle 5, the vacuum connection opening 121 is connected to the opening of the pipe 4. To accomplish this, preferably the vacuum connection opening 121 comprises a rearwardly extending connector pipe, as shown generally by reference numeral 123. After the vacuum connection opening 121 has been connected to the pipe 4 and the main body 101 of mounting plate 100 has been secured to the structural element 7, the electrician will generally return to insert the receptacle 5 in the electrical box 8. After this step, the vacuum inlet face plate 14 can then be attached to the vacuum connection opening 121. In one embodiment, the vacuum inlet connection opening 21 preferably comprises a rearwardly extending opening 23 and the vacuum connection opening 121 preferably comprises a rearwardly extending opening 123. The rearwardly extending opening 123 can preferably receive and sealably mate with the vacuum connection opening 121 of the mounting plate 100. It is understood that when the vacuum connection opening 121 receives the vacuum connection 31 of the hose cuff 30, this is done in this embodiment by the vacuum inlet connection opening 21 receiving the vacuum connection which in turn is located within the vacuum connection opening 121.

FIG. 4 also shows fastening holes 14*a* and 14*b*. These fastening holes 14*a*, 14*b* may optionally be used to secure a cover for the electrical box 8 on top of, or in addition to, the underlying vacuum inlet face plate 14. For instance, this can be done for decorative purposes. Furthermore, this can be done to provide access to the electrical box 8 without requiring removal of the vacuum inlet face plate 14 from the wall and separation of the rearwardly extending conducting pipe 23 of the vacuum inlet connection opening 21 from the rearwardly extending connecting pipe 123 of the vacuum connection opening 121.

Figure 6:
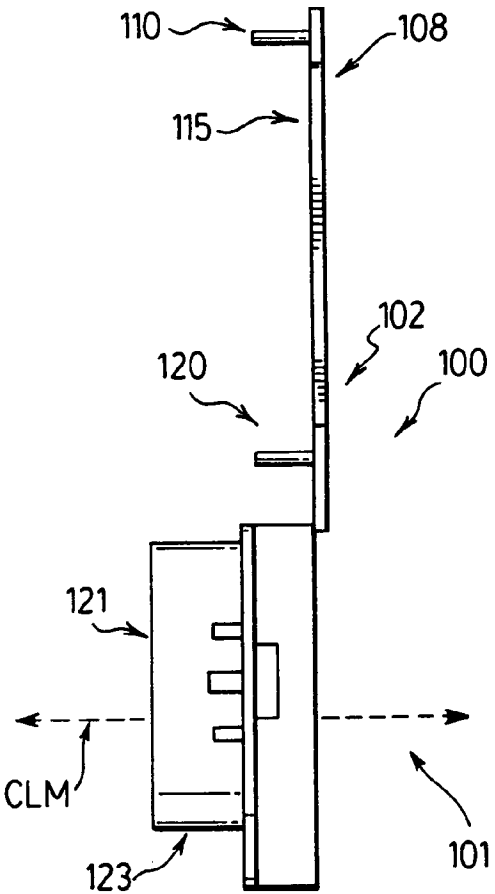
FIG. 6 illustrates a side view of the mounting plate shown in FIG. 5.
Figure 5:
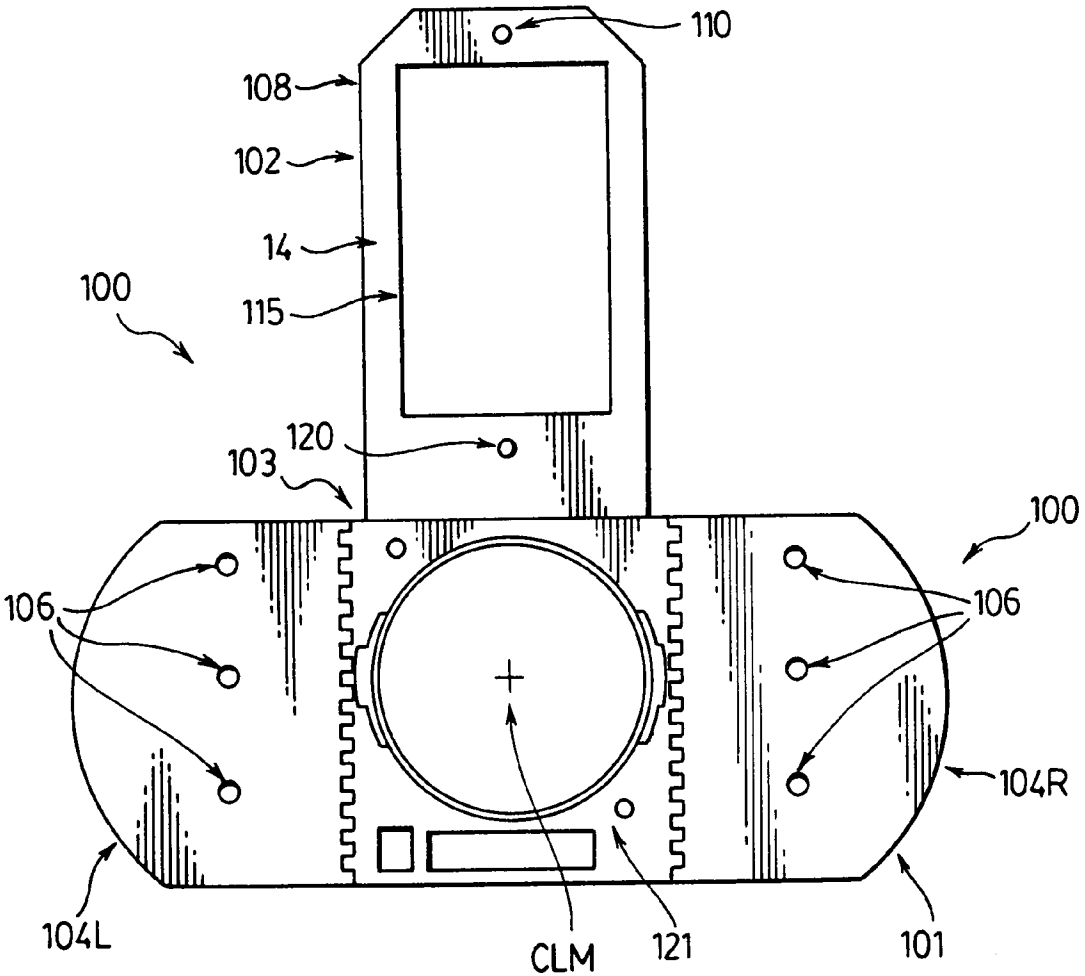
FIG. 5 illustrates a front elevational view of a mounting plate according to one preferred embodiment with preferred dimensions according to a specific preferred embodiment.
Figure 7:
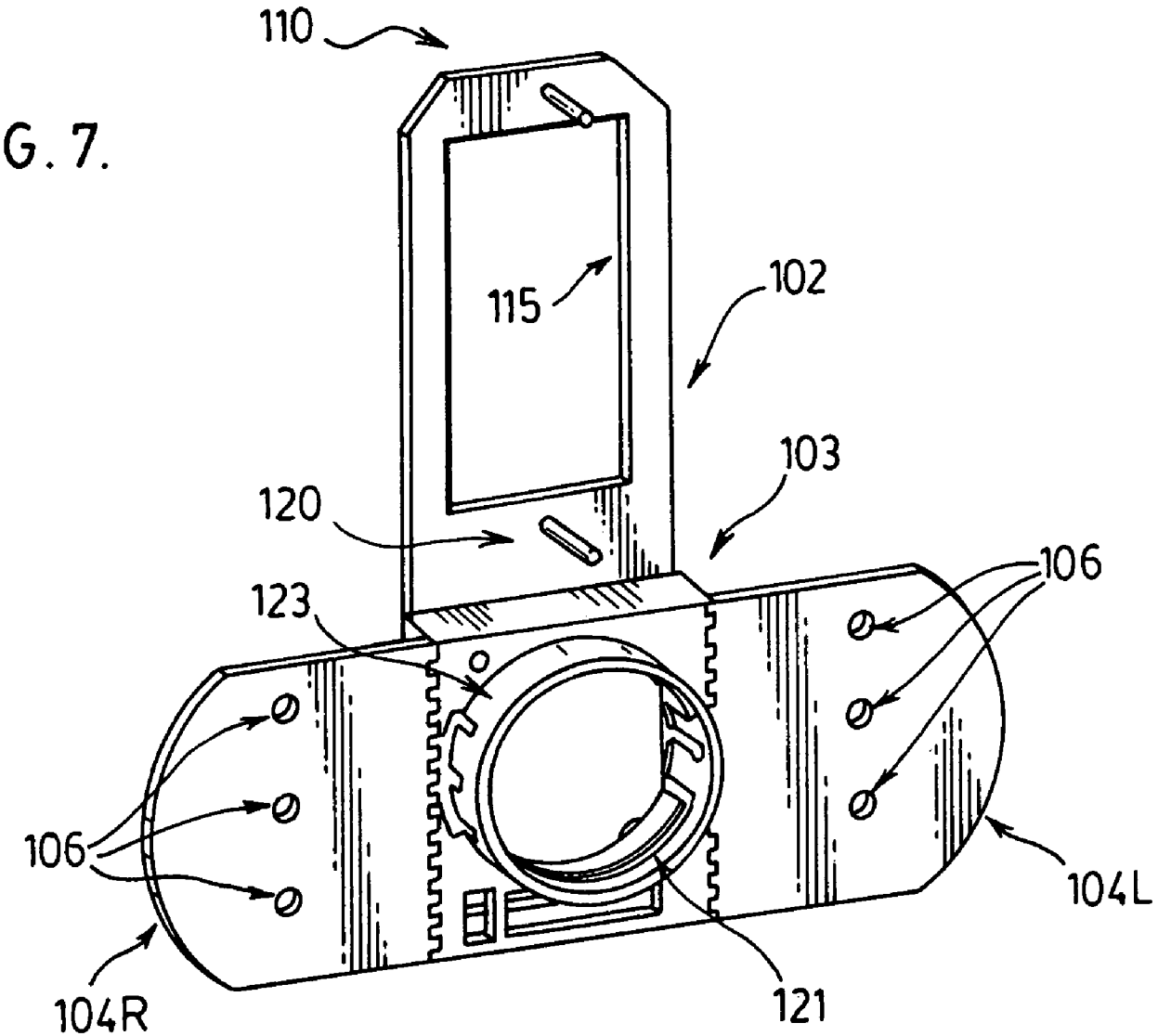
FIG. 7 illustrates a perspective view of the mounting plate according to one preferred embodiment.

FIGS. 5, 6 and 7 show alternate views of the mounting plate 100 according to one preferred embodiment. As illustrated in FIG. 5, the mounting plate 100, according to one embodiment of the present invention, comprises the main body 101 and an orienting portion 102. The main body 101 comprises the vacuum connection opening 121 for connection to the pipe 4 as discussed above. The main body 101 also preferably comprises the mounting flange as 104L and 104R. As illustrated in FIGS. 5 and 7, the mounting flange is 104L and 104R are placed on either side of the vacuum connection opening 121 to facilitate securing the main body 101 to a structural element 7, such as a wall stud, on either of the left side or the right side of the vacuum connection opening 121. Furthermore, the mounting flanges 104L, 104R also comprise mounting holes 106 to facilitate securing the mounting plate 100 onto the structural elements 7. When the vacuum connection opening 121 is in the first orientation with respect to the actual orientation or anticipated orientation of the electrical receptacle 5 inserted in the electrical box 8, nails, screws or other suitable fastening devices could be inserted into the mounting holes 106 for the purpose of securing the mounting plate 100 to the structural element 7.

The orienting portion 102 may comprise any means for orienting the vacuum connection opening 121 with respect to the anticipated orientation of the electrical receptacle 5 when inserted in the electrical box 8. For instance, as illustrated in FIGS. 5, 6 and 7, the orienting portion 102 may comprise at least one locating pin 110, 120 and preferably 2 locating pins for alignment with corresponding features of the electrical box 8. These features may correspond to mounting holes 9 as illustrated for instance in FIG. 8 discussed further below. These mounting holes 9 are generally a known distance apart from each other, such as in a preferred embodiment, 3.23 inches as illustrated in FIG. 5.

Similarly, in this preferred embodiment, the centre point of the vacuum connection opening 121 is a fixed known distance from the lower locator pin 120. As illustrated in FIG. 5, this first known position is 1.61 inches. This is the case so that, when the mounting plate 100 is used in association with a standard electrical box 8, the vacuum connection opening 121 can be connected to a pipe 4 without interference with the electrical box 8. It is understood that this distance is a very specific distance depending on the diameter of the pipe 4, the diameter and shape of the vacuum connection opening 121 and the dimensions and standards used for the electrical box 8. In general, the distance 1.61 shown in FIG. 5, when used with a standard electrical box 8 will result in the centre line CLM of the vacuum connection opening 121 being about 2.61 inches below the mid-point of the lower plug 5*b* of the electrical receptacle 5 when it is inserted in the electrical box 8. In this way, in a preferred embodiment, the first orientation corresponds to the centre line CLM of the vacuum connection opening 121 being located 2.6 inches below the anticipated position of the mid-point of the lower plug 5*b* or in other words 1.6 inches directly below the lower mounting hole 9 of the electrical box 8 as shown in FIG. 5A. However, it is understood that this is merely one preferred first known orientation and other orientations may be useful. It is noted that all other electrical boxes (not shown) may have different dimensions.

Optionally, the orienting portion 102 may also have a locating frame 115 which fits within the frame of the electrical box 8. As illustrated in FIGS. 5, 6 and 7, the orienting portion 102 may have one or more of these features so as to facilitate orientation of the vacuum connection opening 121 in the first orientation with respect to the anticipated orientation of the electrical receptacle 5 when inserted in the electrical box 8. Furthermore, the orienting portion 102 may comprise any mounting flange 108, upon which the locator pins 110, 120 and locating frame 115 may be placed.

The mounting plate 100 may also comprise a frangible portion 103. The frangible portion 103 separates the orienting portion 102 in the main body 101 according to one preferred embodiment. Once the orienting portion 102 has oriented the vacuum connection opening 121 in the first orientation with respect to the anticipated orientation of the electrical receptacle 5 when inserted in the electrical box 8, the frangible portion 103 permits the orienting portion 102 to be separated from the main body 101. In this way, the orienting portion 102 will not interfere with the installation of the electrical receptacle 5 in the electrical box 8. It is understood that the orienting portion 102 will be separated from the main body 101 generally after the main body 101 has been secured to the structural element 7 or the vacuum connection opening has been otherwise fixed in the first orientation with respect to the anticipated orientation of the electrical receptacle 5.

Figure 17B:
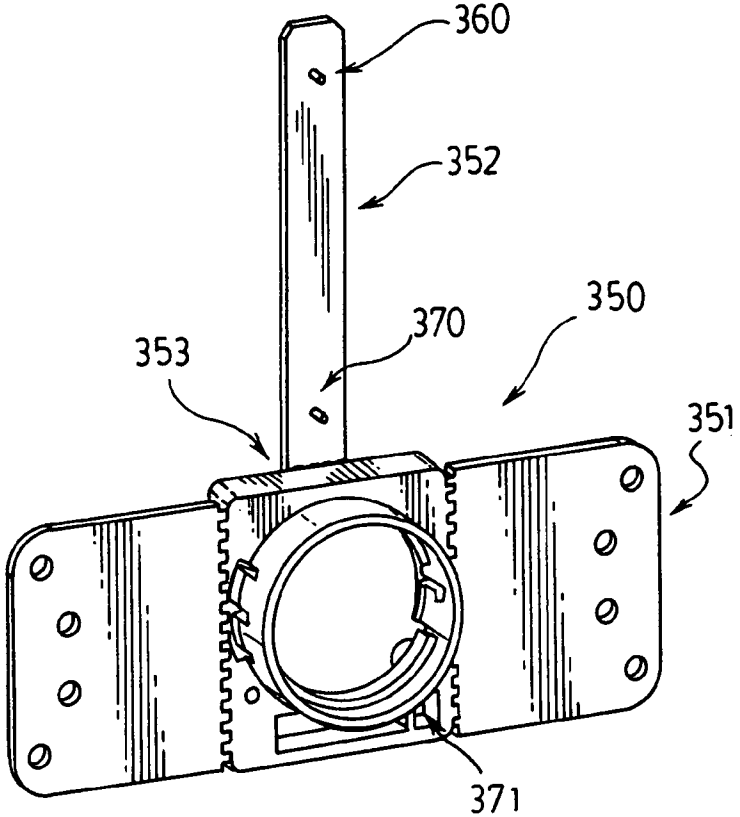
FIG. 17 illustrates a perspective view of a mounting plate according to an alternate preferred embodiment.
Figure 17A:
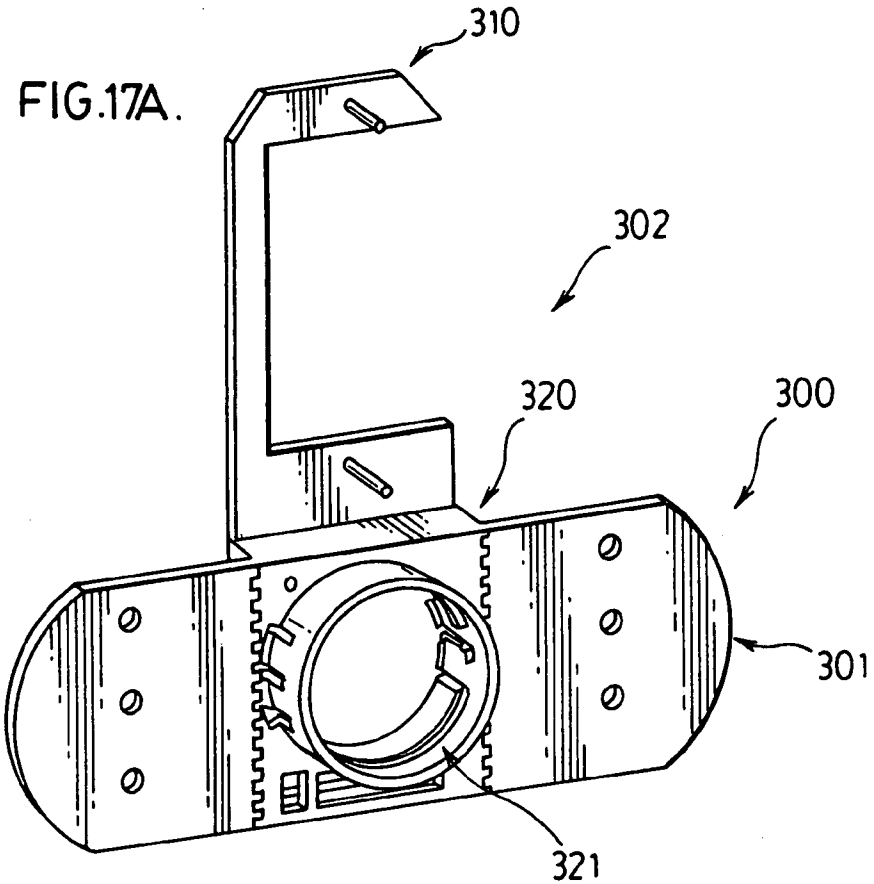
Figure 19:
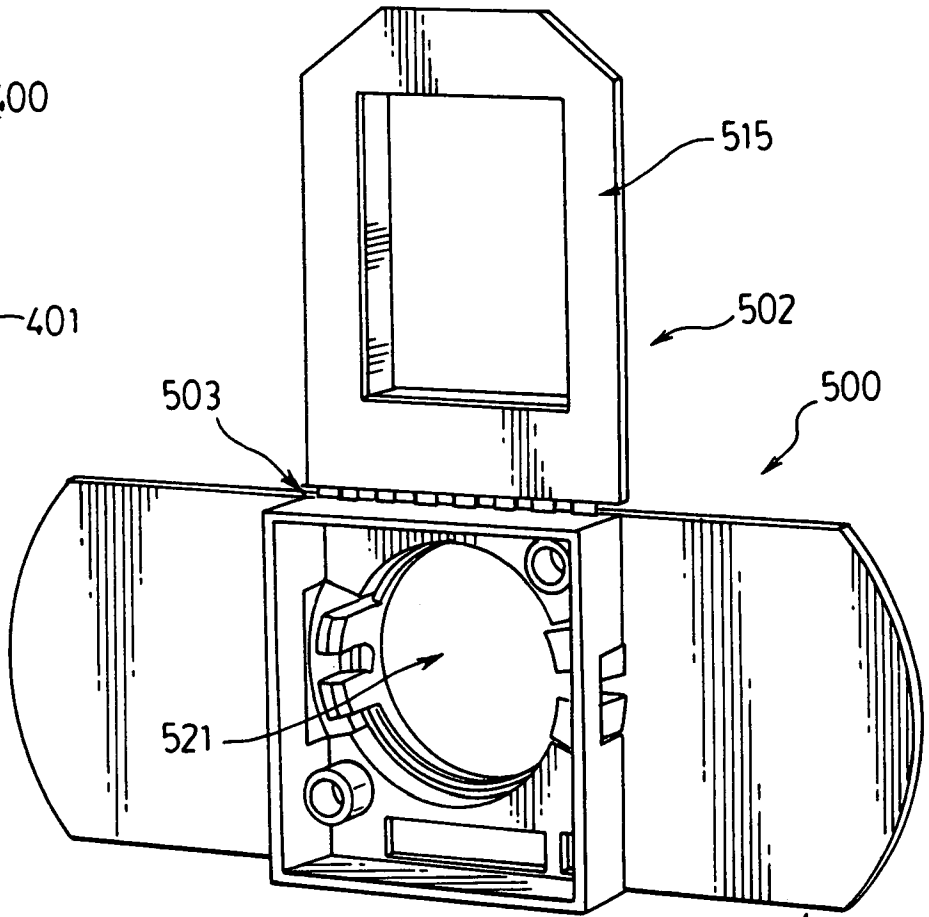
FIG. 19 illustrates the mounting plate according to a further preferred embodiment.
Figure 18:
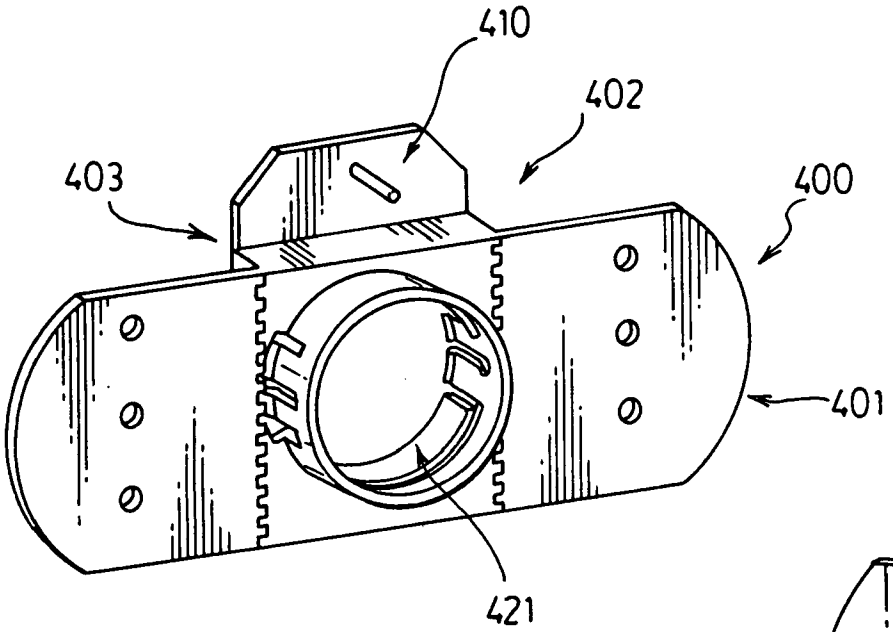
FIG. 18 illustrates a perspective view of a mounting plate according to a further preferred embodiment.

FIGS. 17, 18 and 19 illustrate alternate preferred embodiments of the present invention. For instance, FIG. 17 illustrates a mounting plate 300 having two locator pins 310, 320 on an orienting portion 302 which has a C shape. The orienting portion 302 of the embodiment shown in FIG. 17 would facilitate the orientation of the vacuum connection opening 321 in the first orientation with respect to the anticipated orientation of the electrical receptacle 5 when inserted in the electrical box 8 by the locator pins 310 and 320 engaging the mounting holes 9 in the electrical box 8, would use less material.

Similarly, FIG. 18 illustrates a further embodiment of a mounting plate, shown as reference numeral 400. In FIG. 18, the mounting plate 400 has a single locator pin 410 for engaging a single mounting hole 9 in the electrical box 8. It is understood that with the single hole 410, the vacuum connection opening 421 may not be uniquely oriented, but this can be overcome simply by permitting the mounting plate 400 to pivot about the locator pin 410 when inserted in the mounting hole 9 of the electrical box 8 such that gravity will drive the vacuum connection opening 421 to the first orientation with respect to the electrical receptacle 5 which would be a known distance directly below the electrical box 8. Furthermore, the main body 401 of the mounting plate 400 may be placed by eye in the first orientation using the locator pin 410 inserted in the mounting hole 9 of the electrical box 8 to obtain the proper distance.

FIG. 19 shows still a further embodiment of the present invention where the mounting plate 500 comprises a locating frame 515 without any locator pins. The locating frame 515 on the orienting portion 502 facilitates orienting of the vacuum connection opening 521 in the first orientation by the frame 515 engaging the opening of the electrical box 8. The main body 501 can then be secured to the structural elements 7. The mounting plate 500 does not show mounting holes illustrating that means other than nails and screws, such as and including adhesives, epoxies and friction fits, can also be used to secure the main body 501 with the vacuum connection opening 521 in the first orientation.

Figure 20:
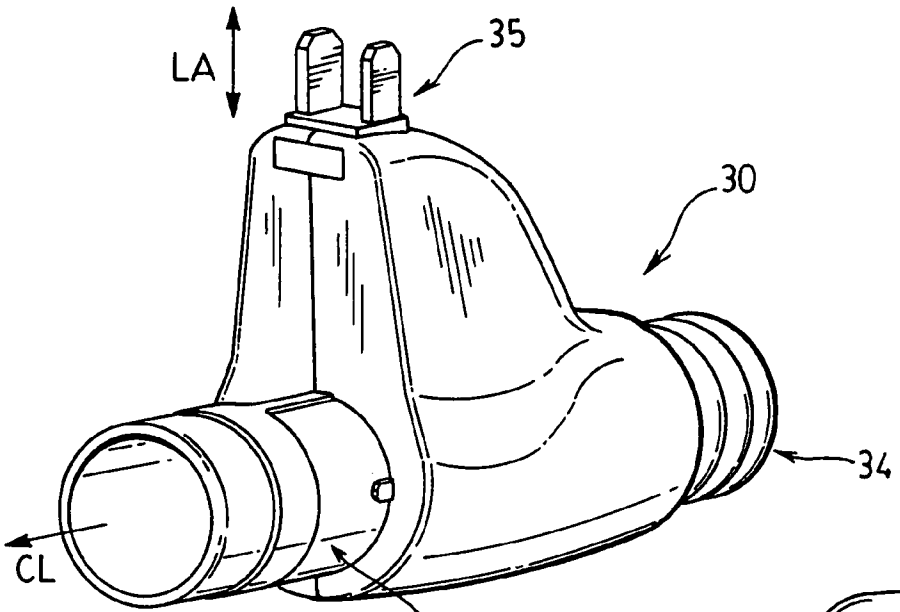
FIG. 20 illustrates the hose cuff according to a further preferred embodiment for use with inlet valves that have not been installed using the present invention.

Each of FIGS. 18, 19 and 20 also show frangible portions 303, 403 and 503 separating the orienting portions 302, 402 and 502 from the main bodies 301, 401 and 501, respectively. This permits separation of the orienting portion 302, 402 and 502 from the main bodies 301, 401 and 501 after the plates 300, 400 and 500 have been secured to a structural member or otherwise have been fixed such that the vacuum connection openings 321, 421 and 521 are in the first orientation with respect to the anticipated orientation of the electrical receptacle 5 when inserted in the electrical box 8. It is understood that use of frangible portions 303, 403, 503 as well as 103, are feature of preferred embodiments and, if the orienting portions 102, 302, 402 and 502 are to be removed, they could simply be cut, bent, broken off or otherwise separated from the main bodies 101, 301, 401 and 501, respectively. The frangible portions 103, 303, 403 and 503 are merely used to facilitate this removal and not damage the main body 101, 301, 401 and 501. It is understood that the frangible portions 103, 303, 403 and 503 may be any means, including a weaker or more brittle plastic, perforations, etching or other techniques, to facilitate breaking or separation at or along a predetermined location.

Figure 8:
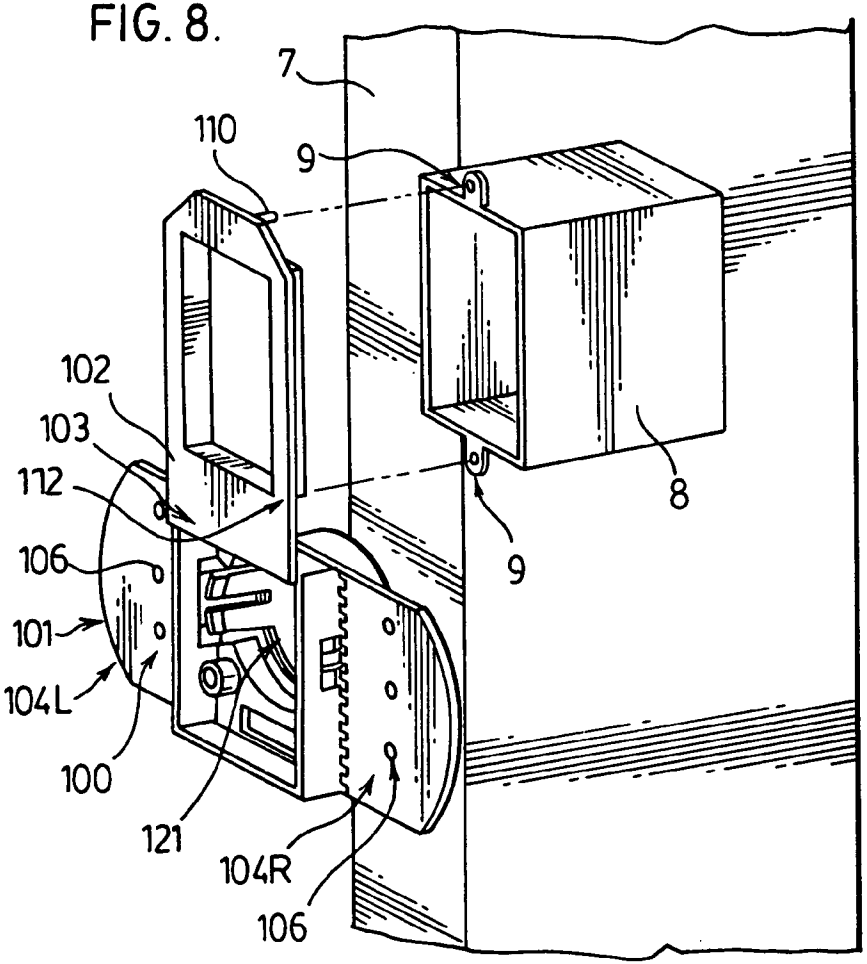

A more detailed discussion regarding the installation of the mounting plate 100 and inlet valve 20 will now be provided with reference to FIGS. 8 to 13B. FIG. 8 illustrates the step in a typical home or building construction where the structural elements 7, such as wall studs, have been installed and an electrician will attend to the construction site and install appropriate electrical boxes 8. Generally, after the electricians visit, the duct work (not shown) is installed and after that the central vacuum cleaner installers can attend at the construction site.

FIG. 8 illustrates the installation of the mounting plate 100 according to one embodiment of the present invention after the electrician has installed the electrical box 8. As illustrated in FIG. 8, there is no receptacle 5 yet installed in the electrical box 8. At this time, the main body 101 of the mounting plate 100 having the vacuum connection opening 121 for the vacuum inlet valve 20 (not yet installed in FIG. 8) are mounted to the structural elements 7. This can be done by inserting nails, screws and other fastening devices into the holes 106 on the mounting flange 104L. Because the electrical receptacle 5 has not yet been inserted, the orienting portion 102 orients the vacuum connection opening 121 with respect to the anticipated position 105A of the electrical receptacle 5. For instance, the locator pins 110, 120 may be inserted temporarily into the holes 9 of the electrical box 8. Alternatively, any other means may be used to orient the vacuum connection opening 121 of the main body 101 with respect to the anticipated position 105A of the electrical receptacle 5.

Figure 9:
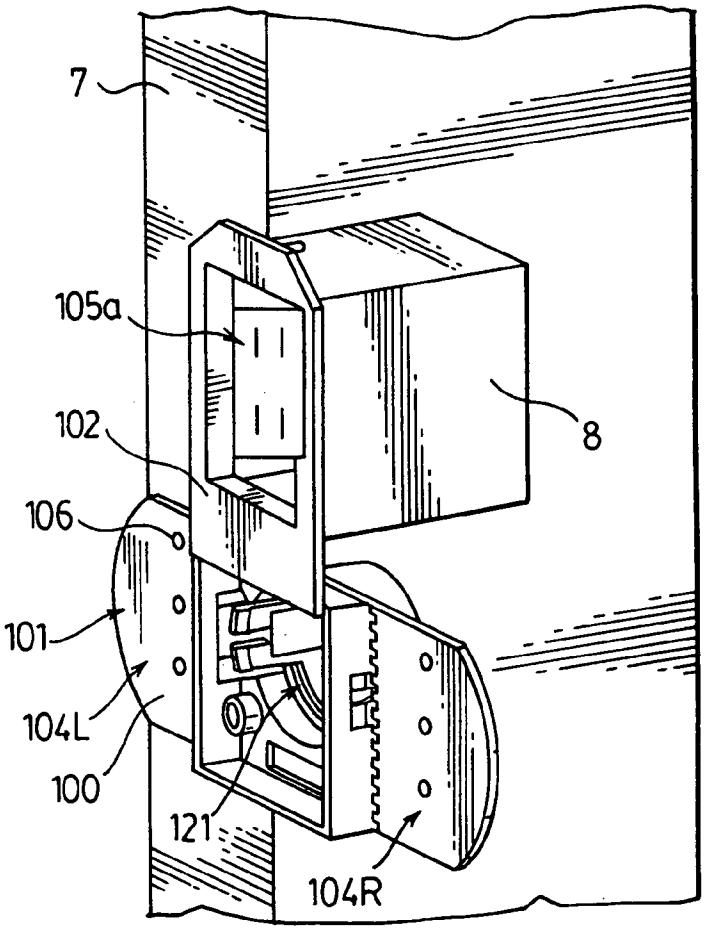
FIGS. 8, 9, 10, 11, 12, 13A and 13B illustrate various steps in the installation of the inlet valve with respect to an electrical box using the mounting plate according to one preferred embodiment of the present invention.

FIG. 9 shows the anticipated position of the electrical receptacle 5 shown in dashed lines and identified generally by reference numeral 5*a*. As illustrated in FIG. 9, the vacuum connection opening 121 will be oriented with respect to the electrical receptacle 5 such that it is directly below the electrical receptacle 5, however it is understood that any other type of orientation could also be used. Furthermore, as also discussed above, it is preferable that the first orientation of the vacuum connection opening 121 with respect to the anticipated position 105*a* of the electrical receptacle 5 is selected so as to prevent interference between the central vacuum cleaning system 1, including the mounting plate 100 and the pipe 4 connected to the mounting plate 100, and the electrical box 8. This is to avoid the need to use specialized electrical boxes (not shown) thereby decreasing the cost of the overall system. This is also the case to ensure that the invention satisfies existing building code requirements and does not present unnecessary electrical or fire hazards. In the preferred embodiment, the first orientation is selected such that a centre line CL of the vacuum connection opening 121 is a minimum of 2.6 inches below a bottom electrical plug 5*b* of the electrical receptacle 5 when the electrical receptacle 5 has been inserted in the electrical box 8. It is also understood that this orientation will correspond to the orientation of the electrical terminals 35 with respect to the vacuum connection 31 of the hose cuff 30. In other words, electrical terminals 35 of the hose cuff 30 will be separated by about 2.6 inches from the centre line CL of the vacuum connection 31 of the hose cuff 30. It is understood that any type of orientation of the electrical terminals 35 with respect to the vacuum connection 31 of the hose cuff 30 may be used, provided this orientation corresponds to the first known orientation of the vacuum connection opening 121 with respect to the anticipated position 105A of the electrical receptacle 5.

As illustrated in FIG. 9, when the vacuum connection opening 121 has been oriented to the first known orientation with respect to the anticipated orientation of the electrical receptacle 5, the main body 101 of the mounting plate 100 may be secured to the stud 7 by inserting the nails or screws, or other proper fastening devices into mounting holes 106. Accordingly, FIG. 9 illustrates that, after the electrical box 8 has been installed and secured to a structural element 7, and before the electrical receptacle 5 has been inserted in the electrical box 8, the vacuum connection opening 121 has been oriented in the first known orientation with respect to an anticipated orientation of the electrical receptacle 5 when it is finally inserted in an electrical box 8.

Figure 11:
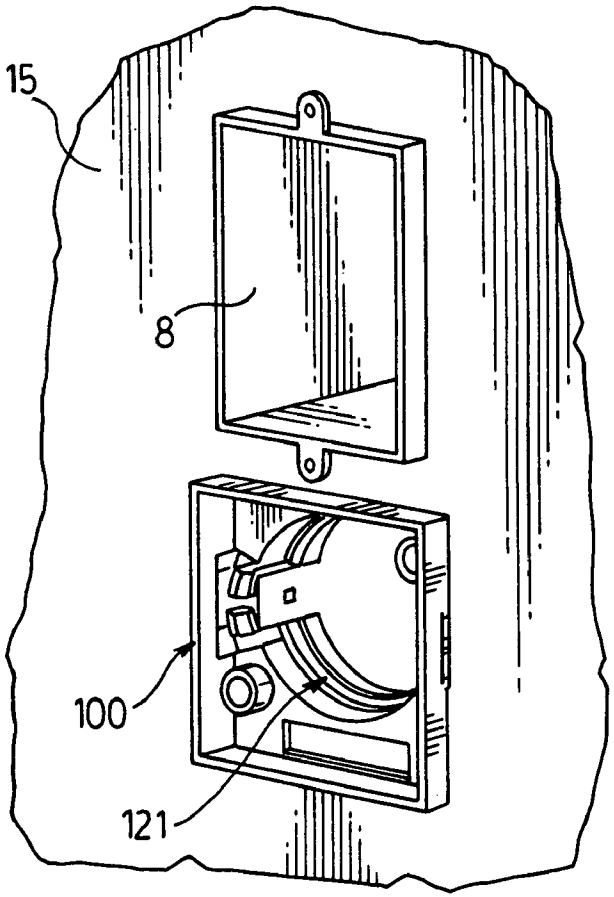
Figure 10:
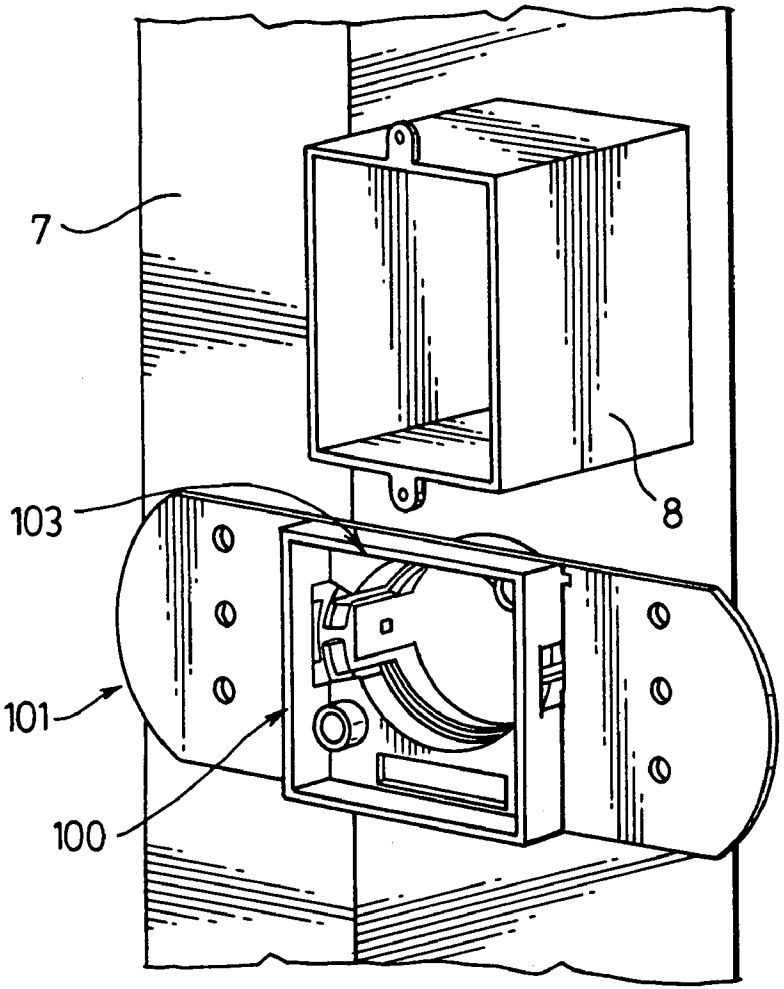

FIG. 10 shows a further preferred embodiment to the present invention where the orienting portion 102 is separated from the main body 101 by a frangible portion 103. This frangible portion 103 can be any known means to removeably attach the orienting portion 102 with respect to the main body 101 and then remove the orienting portion 102 once the main body 101 has been secured to a structural element 7 in the first orientation. This is illustrated for instance in FIG. 10 by the orienting portion 102 having been removed along the frangible portion 103. Removing the orienting portion 102 also permits the electrician and other trades to work around the mounting plate 100 without interference by the orienting portion 102. For instance, FIG. 11 shows a further step where the drywall 15 has been mounted in and around the mounting plate 100 and the electrical box 8. If the orienting portion 102 was still present, the orienting portion 102 could have interfered with other trades, such as the drywallers installing the drywall 15.

Figure 12:
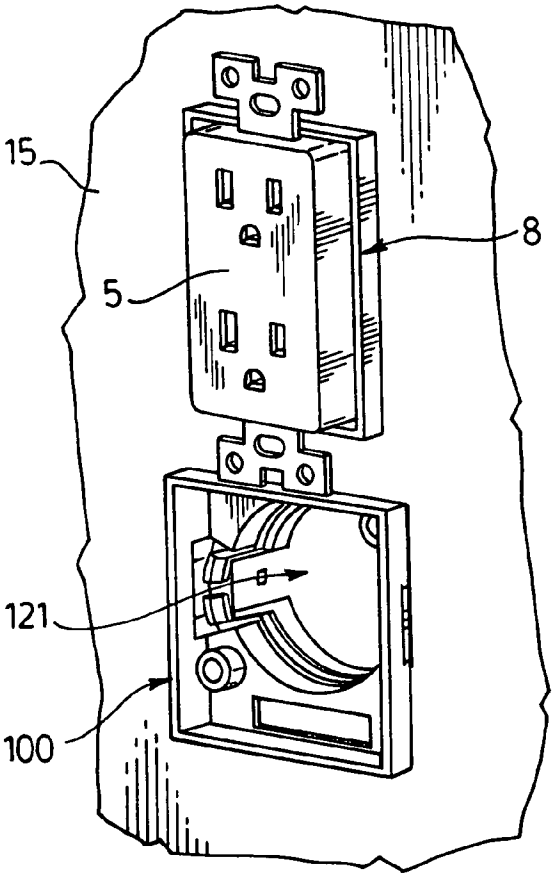

FIG. 12 shows the insertion of the electrical receptacle 5 by the electrician into the standard electrical box 8. As with the addition of the drywall 15, the presence of the orienting portion 102 could interfere with insertion of the electrical receptacle 5 and the electrical box 8. Therefore, for this reason also, it is preferred that the orienting portion 102 is removed from the main body 101. In a preferred embodiment, the frangible portion 103 facilitates removal of the orienting portion 102 from the main body 101, but or any other means for permitting removal of the orienting portion 102 after the orienting step has been completed such as cutting or breaking, may also be used.

Figure 13A:
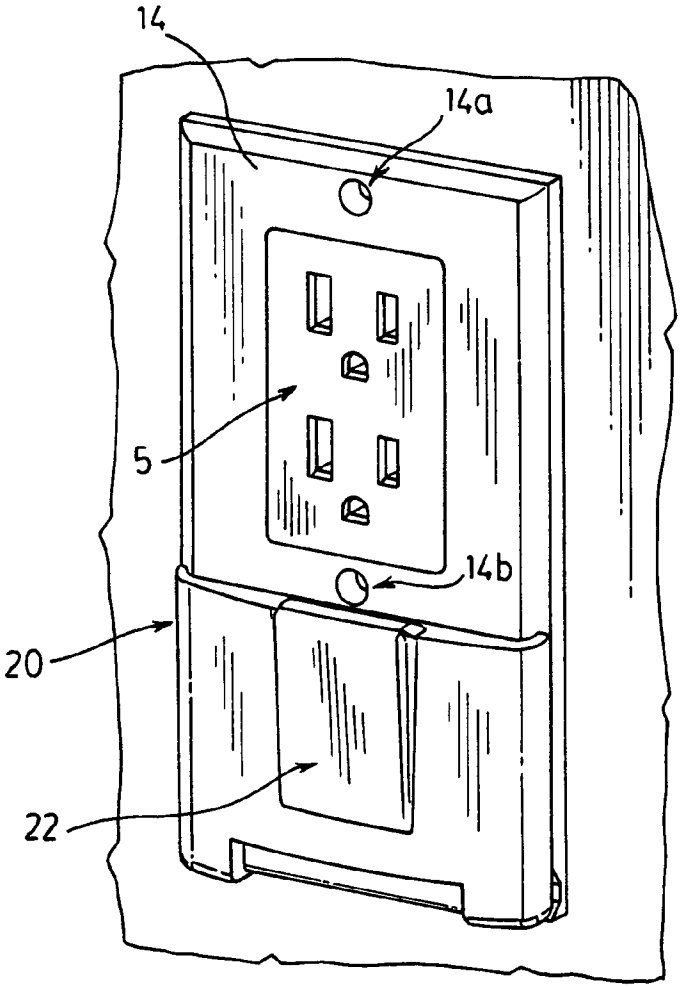

FIG. 13A illustrates the installation of the vacuum inlet face plate 14. As illustrated in FIG. 13A, the vacuum inlet face plate 14 comprises the vacuum inlet valve 20 and the vacuum inlet valve cover 22. The vacuum inlet face plate 14 illustrated in FIG. 13A also comprises an electrical box cover which is secured by fastening holes, 14*a*, 14*b*, but it is understood that this is merely one preferred embodiment and alternate embodiments could be used. For instance, the vacuum inlet face plate 14 could be separated from the electrical box cover (not shown) such that there is a space where drywall 15 or other material may be present. Furthermore, if the vacuum system is merely roughed in, the vacuum inlet face plate 14 may not have a vacuum inlet valve cover 22 but rather could simply extend downwards to cover the vacuum connection opening 121 of the mounting plate 100 until such time as a vacuum system 1 is installed.

Figures 13B, 14:
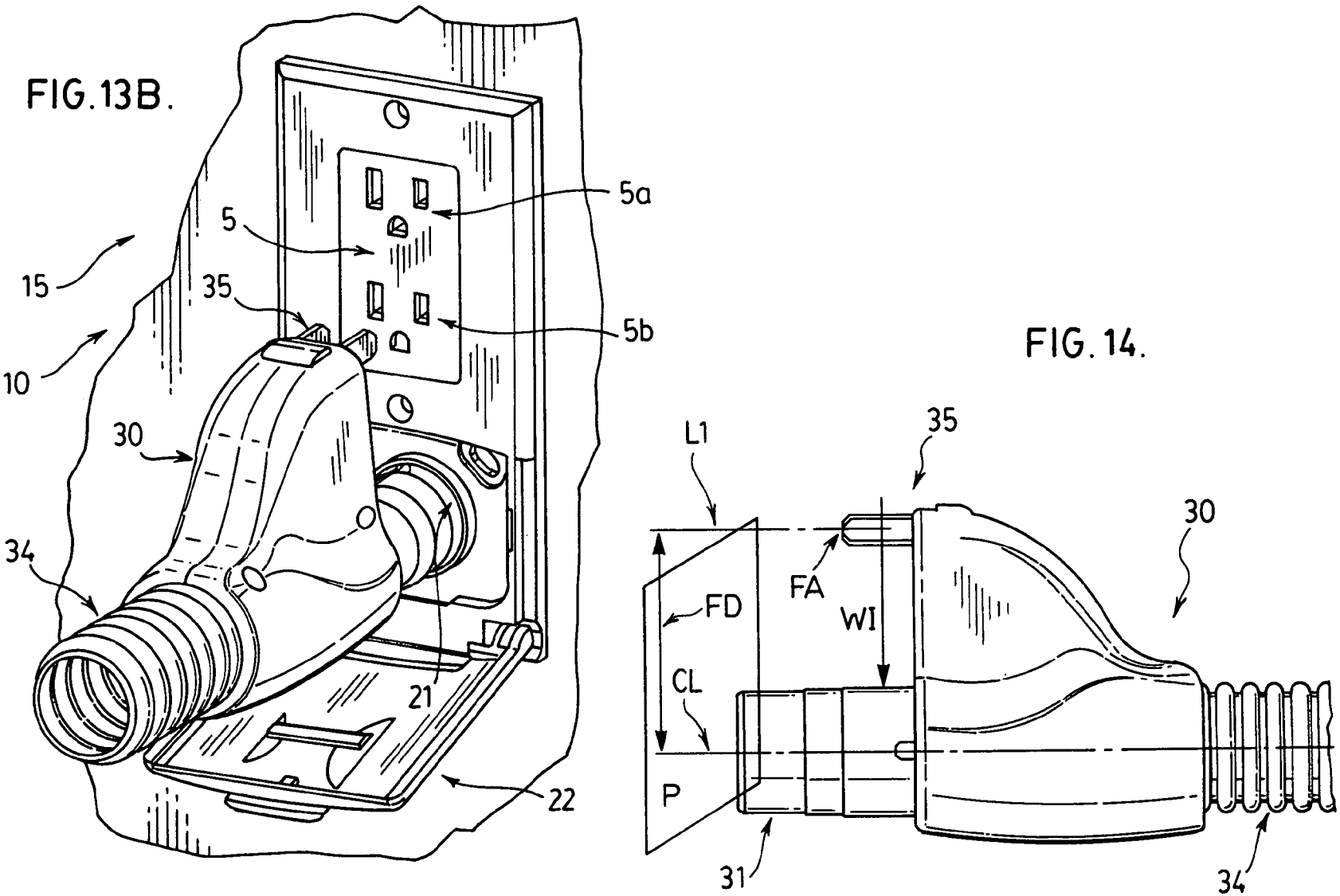
FIG. 14 illustrates a side view of a hose cuff according to one embodiment of the present invention.

FIG. 13B illustrates the combination of the installed vacuum inlet valve cover 22 and hose cuff 30, shown generally by reference numeral 10. FIG. 13B is similar to FIG. 2 discussed above. FIG. 13B illustrates that after the mounting plate 100 has been mounted in the first orientation and after the electrical receptacle 5 has been inserted in the electrical box 8 in the anticipated orientation, the drywall 15 has been installed and the vacuum inlet face plate 14 has been installed, the hose cuff 30 at one end of a current carrying flexible hose 34 and having electrical terminals 35 oriented with respect to the vacuum connection 31 in a second orientation corresponding to the first orientation may be inserted into the vacuum inlet connection opening 21 such that the electrical terminals 35 mate with the electrical receptacle 5, in particular, the lower plug 5*b* shown in FIG. 13B, when the vacuum connection opening 121 receives the vacuum connection 31.

FIG. 14 illustrates the structure of the hose cuff 30 according to one preferred embodiment. As illustrated in FIG. 14, the hose cuff 30 comprises a vacuum connection 31 for mating with the vacuum inlet connection opening 21 of an inlet valve 20 which is coincident with the vacuum connection opening 121 of the mounting plate 100. The vacuum connection 31 has a centre line, shown generally by reference numeral CL. The hose cuff 30 also comprises a pair of standard electrical terminals, shown generally by reference numeral 35, which in at least one preferred embodiment is fixed to the hose cuff 30 with respect to the vacuum connection 31. It is understood that alternate embodiments where the electrical terminals may be moveable and/or rotatable are also contemplated as discussed briefly below. In either case, the electrical terminals 35 are generally aligned along a first axis FA shown by dashed lines extending into the page in FIG. 14. FIG. 14 also illustrates a plane, identified by reference numeral P, which also extends into and out of the page upon which FIG. 14 is located and contains the first axis FA. The hose cuff 30 is preferably manufactured such that the centre line CL is offset from the first axis FA by a first distance and the centre line CL is substantially perpendicular to the plane P.

In a preferred embodiment, as illustrated in FIG. 14, the preferred distance will be in the range of 2.5" to 5" and, more preferably, about 2.6". A preferred distance FD would also be in a direction perpendicular to a mid point between the electrical terminals such that the centre line CL is equidistant between the terminals 35. This orientation of the electrical terminals 35 to the vacuum connection 31 mirrors the first orientation of the electrical receptacle 5, and, in particular, the lower plug 5*b*, with respect to the centre line of the vacuum connection opening 121. In this way the electrical terminals 35 and vacuum connection 31 of the hose cuff 30 have a second orientation which corresponds to the first orientation of the electrical receptacle 5, and in particular, the lower plug Sb in this embodiment with respect to the vacuum connection opening 121 of the mounting plate 100. In this way, the cuff hose 30 may mate with the vacuum connection opening 121 and a standard electrical receptacle 5 inserted into the electrical box 8. Furthermore, as discussed above, the hose cuff 30, according to one embodiment of the present invention, as illustrated in FIG. 14 will mate with the vacuum connection opening 121 and the electrical receptacle 5 substantially simultaneously. In other words, the vacuum connection 31 of the hose cuff 30 will mate with the vacuum connection opening 121 substantially simultaneously as the pair of standard electrical terminals 35 mate with the plug 5*b* of the standard electrical receptacle 5.

It is also noted that the electrical terminals 35 are standard electrical terminals, or standard electrical blades as used in North America, with each blade extending along a first longitudinal axis L1 and a second widthwise axis W1 for mating with a plug 5*b* of the standard electrical receptacle 5. The first longitudinal axis L1 is substantially parallel to the centre line CL of the vacuum connection 31 and substantially perpendicular to the plane P. Furthermore, the second widthwise axis W1 is contained in the plane P and intercepts the vacuum connection 31 according to one preferred embodiment.

Figure 15A:
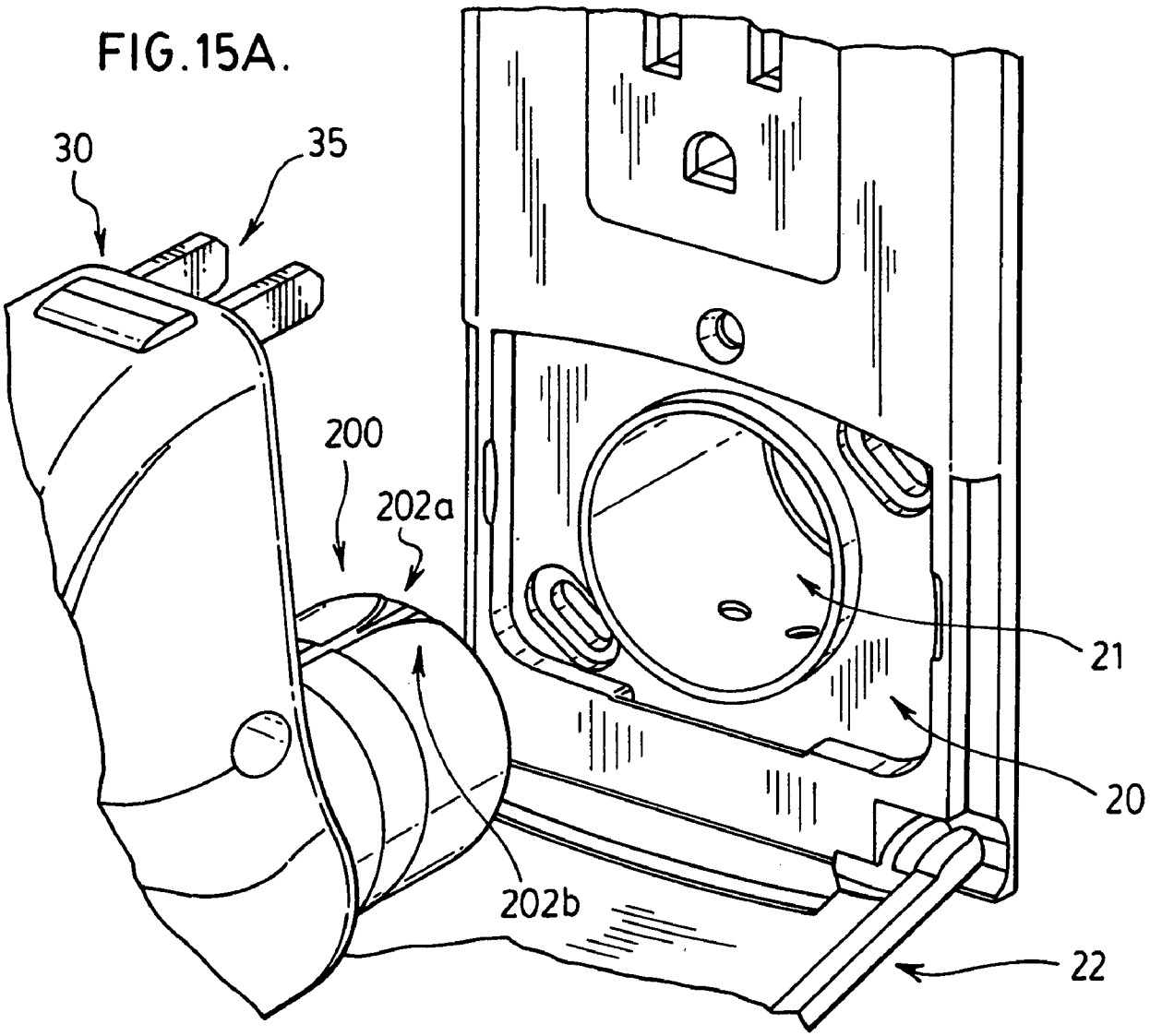
FIGS. 15A and 15B illustrate a further preferred embodiment of the present invention having a male key way on the inlet valve and a female key way on the vacuum connection of the hose cuff.
Figure 15B:
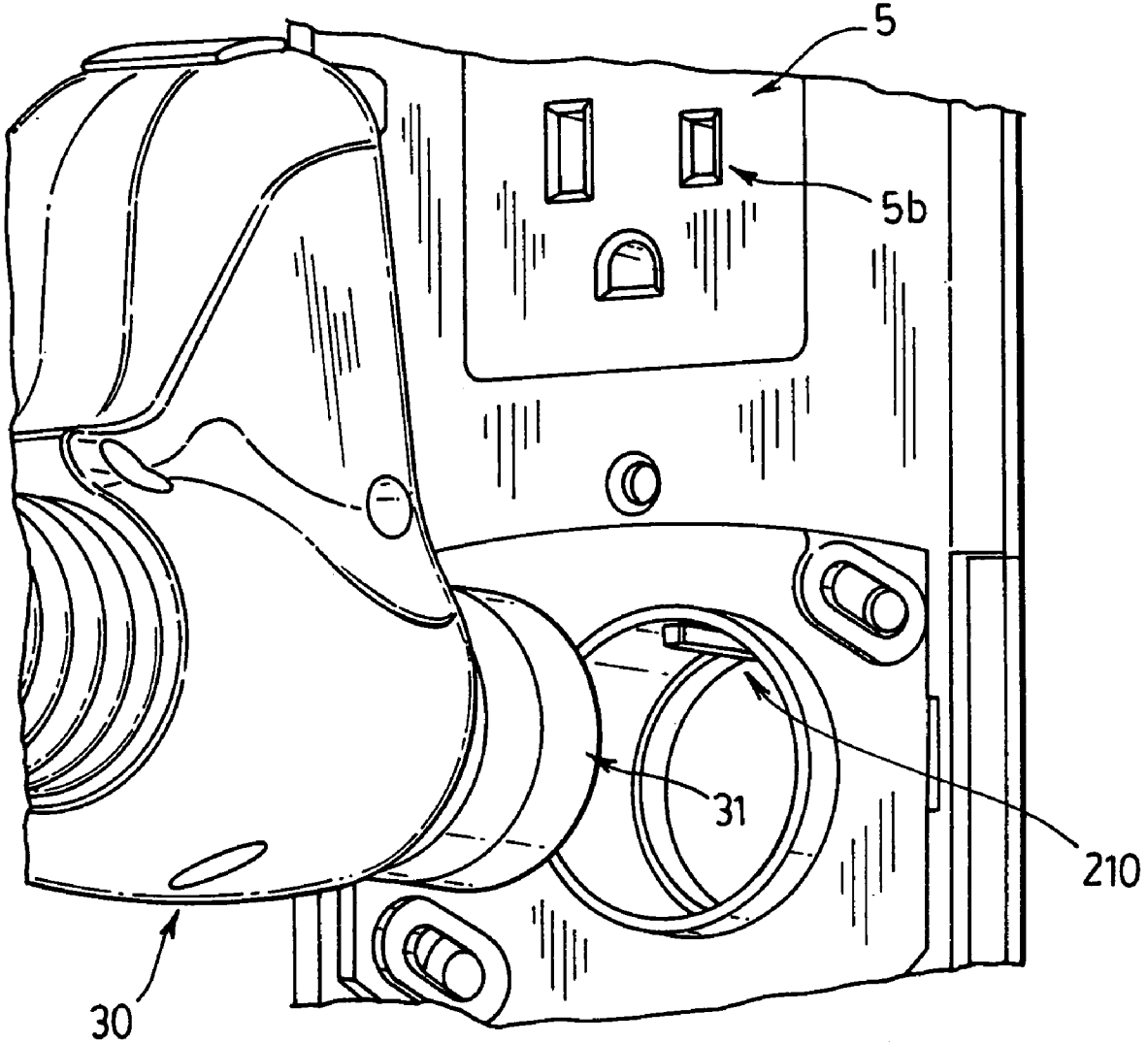
Figure 16:
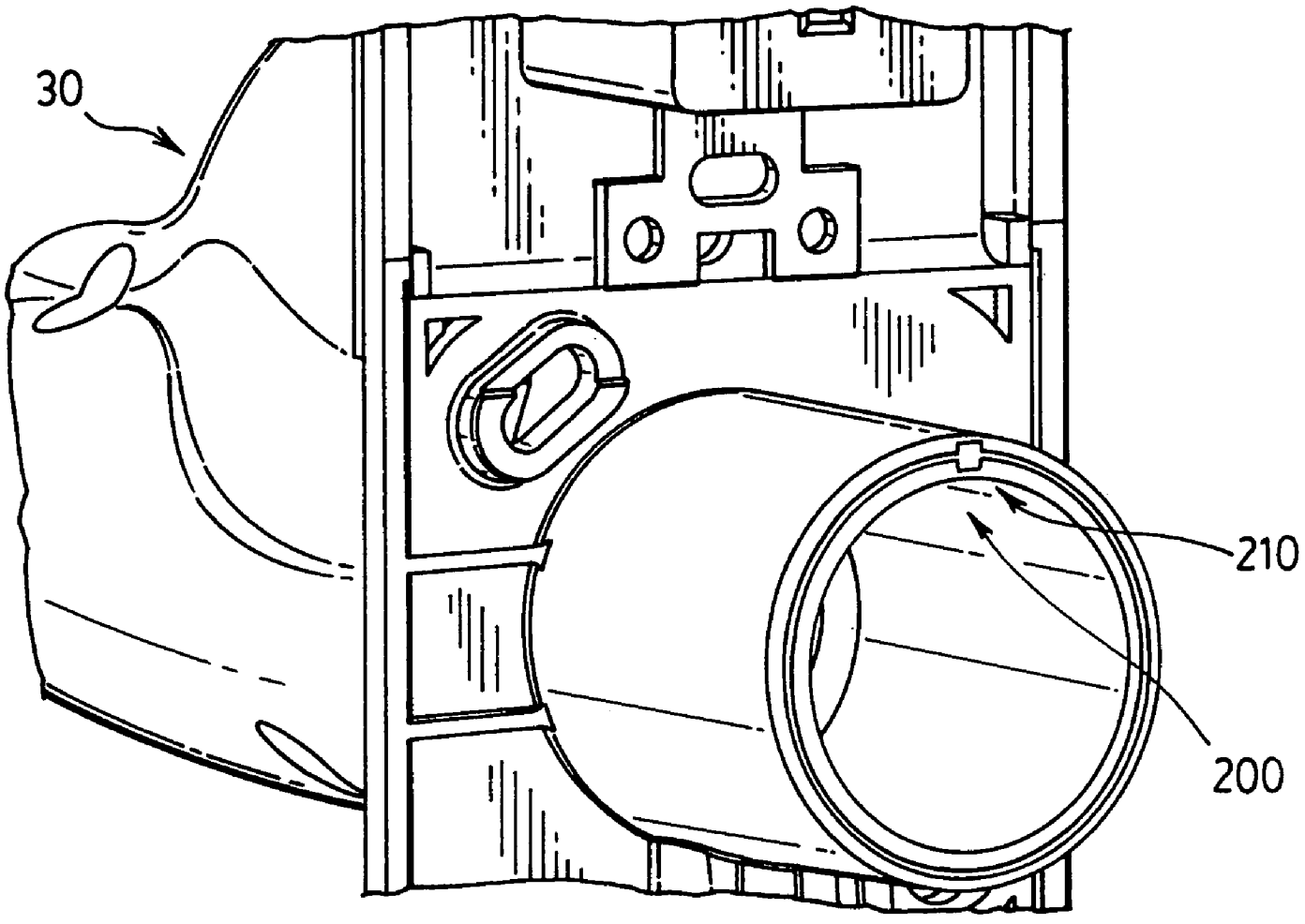
FIG. 16 illustrates the female key way on the vacuum connection of the hose cuff and the male key way on the inlet valve when the hose cuff is inserted into the inlet valve.

FIGS. 15A and 15B show a further preferred embodiment of the present invention. As shown in FIG. 15A, in one preferred embodiment, the vacuum connection 31 of the hose cuff 35 has a female key way, shown generally by reference numeral 200. The female key way 200 mates with a male key way 210 in the vacuum inlet valve 21. The mating of the key ways 200, 210 is also illustrated in FIG. 16. The benefit of the key way is to ensure that the electrical terminals 35 are in the correct alignment to mate with the electrical receptacle 5 and in particular the lower plug 5*b* shown in FIG. 15B. While the electrical terminals 35 are in the correct or first orientation with respect to the centre line of the vacuum connection 31, there is still the possibility that the electrical terminals 35 may not be properly aligned for instance if the vacuum connection 31 rotates with respect to the vacuum connection opening 121. Furthermore, there is a tendency on the part of users to rotate the hose cuff 35 during insertion and rotation in order to loosen the frictional fit. Unfortunately, this rotation may damage or bend the electrical terminals 35. Therefore, the key way 200, 210 facilitates non-rotational insertion and removal of the hose cuff 30 to avoid damaging the terminals 35.

Furthermore, as illustrated in FIG. 15A, the female key way 200 may preferably have at least one tapering surface, such as tapering surface 202*a* and/or tapering surface 202*b*. The tapering surfaces 202*a*, 202*b* are used to facilitate insertion and removal of the vacuum connection 21 into and out of the vacuum connection 121. Furthermore, to further protect the terminals 35, it is preferred that the tapering surfaces 202*a*, 202*b* merge into the female key way 200 at a location which is longitudinally distant from the furthest length of the electrical terminals 35. In other words, during insertion of the vacuum connection 21 into the inlet valve 20, it is preferred that the male key way 210 acts upon the tapering surfaces 202*a*, 202*b*, to align the hose cuff 30 prior to the electrical terminals 35 mating with the electrical receptacle 35 and in particular the lower plug 5*b* in the embodiment illustrated in FIG. 15B. It is understood that this key way 200, 210 as well as the tapering surface 202*a*, 202*b* relate to a further preferred embodiment of this particular invention. Furthermore, it is also understood that the key ways 200, 210 invention may have applicability to other vacuum connections (not shown) having a direct connect electrical contact with or without use of the hose cuff 35/vacuum inlet 21 combination described above. For instance, it is understood that the key ways 200, 210 could be used to facilitate alignment of any vacuum connection and electrical terminal when electrical terminals are fixed with respect to the vacuum connection.

Figure 22:
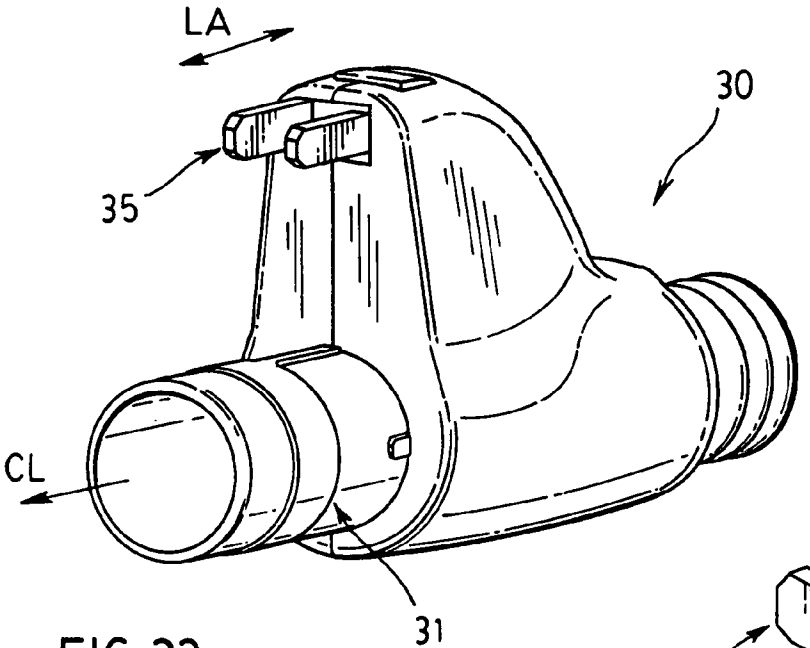
FIG. 22 illustrates a perspective view of the hose cuff for use with an inlet valve installed according to the present invention.
Figure 23:
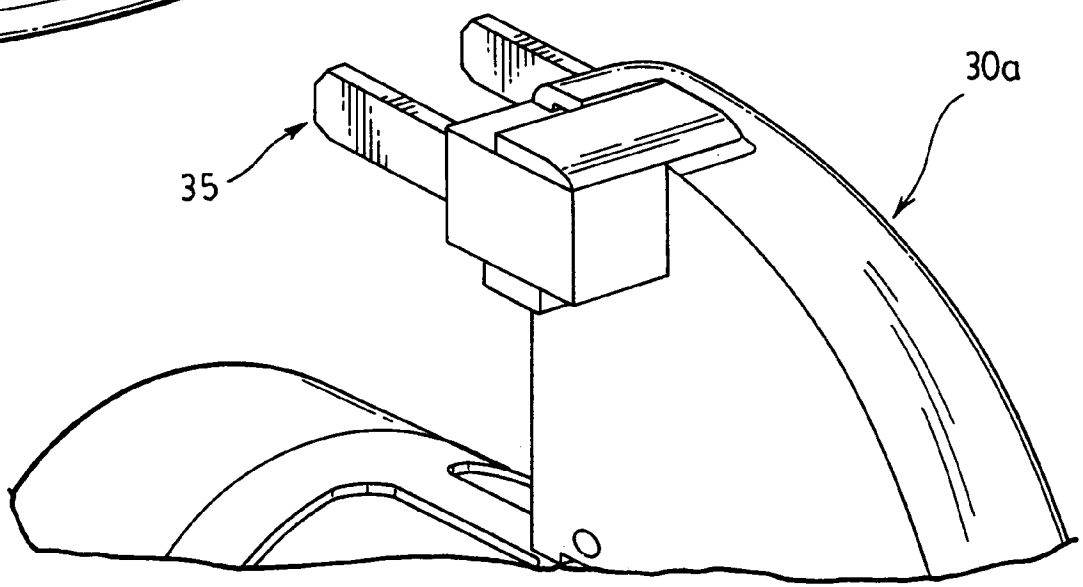
FIG. 23 illustrates the manufacture of the hose cuff illustrated in FIG. 22.

FIG. 22 illustrates an embodiment of the present invention where the hose cuff 30 has the electrical terminals 35 extending in a forward direction with the lengthwise axis LA substantially parallel to the centre line of the vacuum connection 31. This is one embodiment of the hose cuff 30 which can be used with the inlet valve 20 according to one embodiment of the present invention as illustrated for instance in FIG. 2. This hose cuff 30 may be manufactured, in part, by having a separate component for the terminals 35 which can be inserted during the assembly process, as shown in FIG. 23. For instance, the hose cuff 30 may be formed of two separate injection moulded parts, one part of which is shown in FIG. 23 and identified by reference numeral 30*a*. The electrical terminal 35 may be inserted in this forward position when the hose cuff 30 is to be used with the inlet valve 20 of the present invention.

Figure 21:
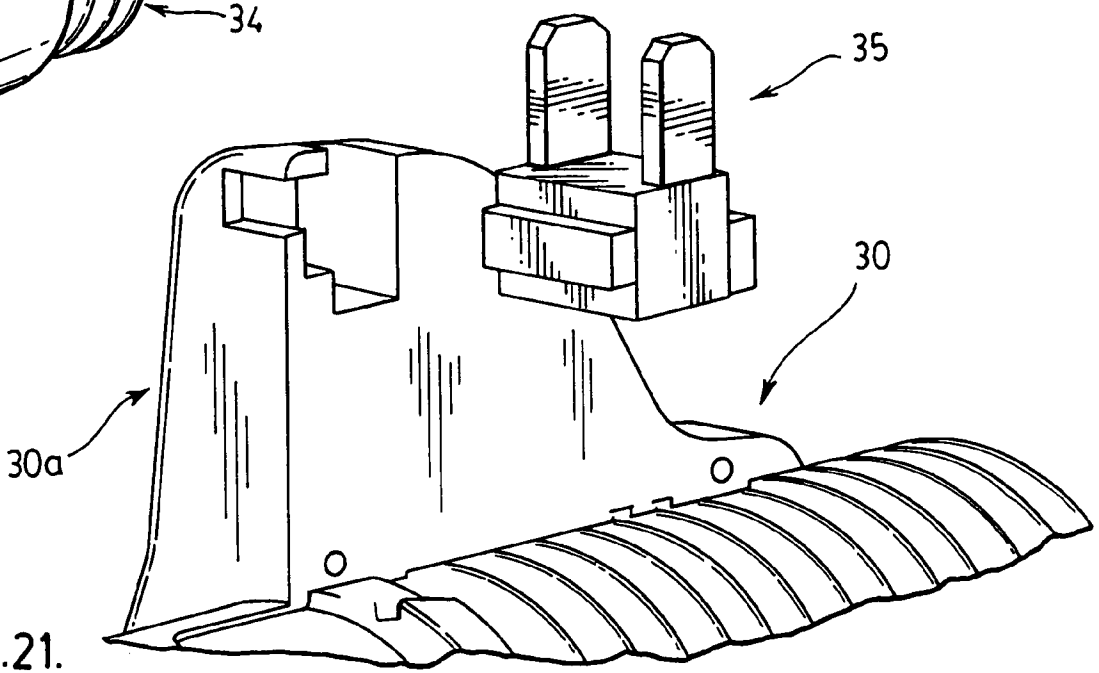
FIG. 21 illustrates one method of manufacturing the hose cuff illustrated in FIG. 20.

Alternatively, if the hose cuff 30 is to be used with conventional inlet valves (not shown), it is preferred if the electrical terminals 35 are in a direction other than the forward direction in order to avoid interference with the wall 15 or other structural member (not shown) when the vacuum connection 31 is inserted into the conventional inlet valve (not shown). For instance, FIG. 20 shows the electrical terminals 35 in an upward direction where the longitudinal axis LA is substantially perpendicular to the centre line of the vacuum connection 31. In this orientation, the hose cuff 30 illustrated in FIG. 20 may be used with an auxiliary cord for connection to a remote standard electrical outlet to provide power to the current carrying hose 34. FIG. 21 illustrates the insertion of the electrical terminal 35, similar to the electrical terminal 35 shown in FIG. 23, into one half 30*a* of the hose cuff 30 during manufacturing.

In this way, according to one preferred embodiment, the same components, namely the electrical terminal 35 and the parts used to manufacture the hose cuff 30 may be used in order to manufacture the hose cuff having a configuration where the electrical terminals 35 extend in a forward direction as illustrated in FIG. 22 which can be used in one embodiment of the present invention, as well as a configuration shown in FIG. 20 where the electrical terminals extend in an upward direction and may be used with a conventional auxiliary cord for connection to a remote standard electrical outlet. This versatility in the manufacturing process of the hose cuff 30 further decreases costs by permitting the same components 30*a*, 35 to be used to manufacture the hose cuff 30 having different configurations as shown in FIGS. 20 and 22.

A further preferred embodiment of the present invention would involve an electrical terminal 35 which may be rotated from the forward direction shown in FIG. 20 to the upper direction shown in FIG. 22. In this way, the same hose cuff 30 may be used with inlet valves 20 according to the present invention and also conventional inlet valves (not shown). This could be used, for instance, in cases where the same structure has conventional inlet valves and inlet valves 20 installed according to the present invention. This may involve a situation where an extension has been made onto an existing structure and the extended portion has used a mounting plate 100 and method according to some of the embodiments of the present invention. It will also be appreciated to persons skilled in the art that alternate configurations of the hose cuff 30 may also be used.

It is understood that the present invention has been described in terms of electrical terminals 35 and in particular electrical blades used in North American electrical receptacles. However, the present invention is not restricted to the North American standard. Rather, the present invention may be used with electrical terminals 35 conforming with any world standards and not necessarily the North American standard. For instance, the present invention may be used with electrical terminals, which are commonly found in various countries in Europe, South America, Asia and Australia. In other words, while the preferred embodiment of the present invention has been described with respect to electrical terminals 35 comprising electrical blades conforming to the North American standard, the present invention is not restricted to such electrical terminals 35, but may be used with electrical terminals 35 conforming to any global standard.

It will be understood that, although various features of the invention have been described with respect to one or another of the embodiments of the invention, the various features and embodiments of the invention may be combined or used in conjunction with other features and embodiments of the invention as described and illustrated herein.

Although this disclosure has described and illustrated certain preferred embodiments of the invention, it is to be understood that the invention is not restricted to these particular embodiments. Rather, the invention includes all embodiments, which are functional, electrical or mechanical equivalents of the specific embodiments and features that have been described and illustrated herein.

The embodiments of the invention in which an exclusive property or privilege is claimed are defined as follows:

1. A mounting plate for use in mounting an inlet valve for use in association with a central vacuum cleaning system, said mounting plate comprising:

a main body having a vacuum connection opening;

an orienting portion for orienting the vacuum connection opening in a known orientation with respect to an anticipated orientation of an electrical receptacle when inserted in an electrical box;

a frangible portion separating the orienting portion from the main body permitting the orienting portion to be separated from the main body; and wherein the vacuum connection opening receives a vacuum connection of a hose cuff, said hose cuff having electrical terminals oriented with respect to the vacuum connection of the hose cuff corresponding to the first known orientation, such that the electrical terminals mate with the electrical receptacle inserted in the electrical box when the vacuum connection opening receives the vacuum connection.

2. The mounting plate as defined in claim 1 wherein the main body comprises a securing member for securing the main body to a structural element when the vacuum connection opening is in the first orientation.

3. The mounting plate as defined in claim 1 wherein after the main body is secured to the structural element, the orienting portion is separated from the main body along the frangible portion.

4. The mounting plate as defined in claim 1 wherein the orienting portion comprises a locating flange having at least one locating pin for alignment with corresponding openings of the electrical box to facilitate orienting the vacuum connection opening in the known orientation with respect to the anticipated orientation of the electrical receptacle when inserted in the electrical box.

5. The mounting plate as defined in claim 4 wherein the at least one locating pin comprises two locating pins, the first locating pin for aligning the mounting plate to a first securing opening of the electrical box and the second locating pin for aligning the mounting plate to a second securing opening of the electrical box.

6. The mounting plate as defined in claim 5 wherein the vacuum connection opening sealably received a vacuum inlet connection opening of a vacuum inlet valve; and wherein said vacuum connection opening receives the vacuum connection of the hose by the vacuum connection being inserted into the vacuum inlet connection opening.

7. The mounting plate as defined in claim 1 wherein the first orientation of the vacuum connection opening with respect to the anticipated orientation of the electrical receptacle when inserted in the electrical box is selected so as to prevent interference between the central vacuum cleaning system and the electrical box.

8. The mounting plate as defined in claim 7 wherein the known orientation is selected such that a centre line of the vacuum connection opening is at least 2.6 inches below a bottom electrical plug of the electrical receptacle inserted in the electrical box; and wherein the electrical terminals are separated by at least 2.6 inches from the centre line of the vacuum connection.

9. The mounting plate as defined in claim 1 wherein the electrical box is a standard electrical box.

10. The mounting plate as defined in claim 9 wherein the electrical receptable is a standard electrical receptable.

11. A method for connecting a current carrying flexible hose to an inlet valve, said method comprising:

(a) after an electrical box has been secured to a first structural element, mounting a main body having a vacuum connection opening for the inlet valve at a first known orientation with respect to an electrical receptacle inserted in the electrical box by aligning an orienting portion removably attached to the main body with the electrical box;

(b) removing the orienting portion from the main body after the main body has been mounted in the first known position; and (c) providing a hose cuff at one end of the current-carrying flexible hose having electrical terminals oriented with respect to the vacuum connection in a second known orientation corresponding to the first known orientation such that the electrical terminals mate with the electrical receptacle inserted in the electrical box when the vacuum connection opening receives the vacuum connection.

12. The method as defined in claim 11, wherein said mounting further comprises:

after the electrical box has been secured to the first structural element, and before the electrical receptacle has been inserted in the electrical box, orienting the vacuum connection opening in the first known orientation with respect to an anticipated orientation of the electrical receptacle when inserted in the electrical box.

13. The method as defined in claim 12 further comprising:

after the electrical box has been secured to the first structural element, orienting the vacuum connection opening in the first known orientation by aligning an orienting portion removably attached to the main body with said electrical box;

mounting the main body at the first known orientation by securing the main body to a second structural element when in the first known orientation;

removing the orienting portion from the main body after the main body has been secured to the second structural element.

14. The method as defined in claim 13 wherein the first structural element coincides with the second structural element.

15. The method as defined in claim 13 wherein the electrical receptacle can be inserted into the electrical box in the anticipated orientation after the orienting portion has been removed from the main body.

16. The method as defined in claim 12 wherein the first known orientation of the vacuum connection opening with respect to the anticipated orientation of the electrical receptacle inserted in the electrical box is selected so as to prevent interference between the central vacuum cleaning system and the electrical box.

17. The method as defined in claim 16 wherein the first known orientation is selected such that a centre line of the vacuum connection opening is a minimum 2.6 inches below a bottom electrical plug of the electrical receptacle inserted in the electrical box; and wherein the electrical terminals are separated by about 2.6 inches from the center line of the vacuum connection of the hose cuff.

18. The method as defined in claim 11 wherein the electrical box is a standard electrical box.

19. The method as defined in claim 18 wherein the electrical receptacle is a standard electrical receptacle.

* * * * *